US012791292B1

(12) United States Patent
Caldwell et al.

(10) Patent No.: US 12,791,292 B1
(45) Date of Patent: Nov. 10, 2026

(54) SEGMENTED PROJECTILE APPARATUS FOR FIREARMS

(71) Applicant: Drone Round, LLC, Gilbert, AZ (US)

(72) Inventors: Calvin Jon Caldwell, Queen Creek, AZ (US); Jordan Dean Zumwalt, Roseville, CA (US)

(73) Assignee: Drone Round, LLC, Gilbert, AZ (US)

( * ) Notice: Subject to any disclaimer, the term of this patent is extended or adjusted under 35 U.S.C. 154(b) by 0 days.

(21) Appl. No.: 19/454,660

(22) Filed: Jan. 21, 2026

Related U.S. Application Data

(60) Provisional application No. 63/887,584, filed on Sep. 25, 2025.

(51) Int. Cl.

| | |
|---|---|
| ***F42B 5/03*** | (2006.01) |
| ***F42B 12/56*** | (2006.01) |
| ***F42B 12/60*** | (2006.01) |
| ***F42B 12/62*** | (2006.01) |

(52) U.S. Cl.
CPC ..... *F42B 5/03* (2013.01); *F42B 12/56* (2013.01); *F42B 12/60* (2013.01); *F42B 12/62* (2013.01)

(58) Field of Classification Search
CPC ..... F42B 5/00; F42B 5/02; F42B 5/03; F42B 8/12; F42B 8/14; F42B 12/00; F42B 12/02; F42B 12/56; F42B 12/58; F42B 12/60; F42B 12/62
USPC ..... 102/438, 439, 501, 506, 517
See application file for complete search history.

(56) References Cited

U.S. PATENT DOCUMENTS

| | | | | |
|---|---|---|---|---|
| 926,431 | A * | 6/1909 | Luger | F42B 5/03 102/438 |
| 1,376,530 | A | 5/1921 | Greener | |
| 3,412,681 | A | 11/1968 | Schirneker | |
| 3,450,050 | A | 6/1969 | Robinson | |
| 3,680,485 | A | 8/1972 | Zaid et al. | |

(Continued)

FOREIGN PATENT DOCUMENTS

| | | |
|---|---|---|
| WO | 9704281 | 2/1997 |

OTHER PUBLICATIONS

International Search Report and Written Opinion, PCT/US2026/014685, mailed Apr. 7, 2026.

*Primary Examiner* — James S Bergin
(74) *Attorney, Agent, or Firm* — Master Key IP, LLP; Justin G. Sanders

(57) ABSTRACT

A segmented projectile apparatus for a firearm is disclosed. In at least one embodiment, the apparatus provides a projectile casing and a projectile assembly frictionally positioned therewithin and providing a projectile nose and a plurality of projectile segments temporarily engageable with one another in axially aligned series. A volume of compressed propellant material is positioned substantially between a rearwardmost one of the projectile segments and a casing primer of the projectile casing, such that the propellant material and a casing neck of the projectile casing cooperate to assist with maintaining the temporary engagement between the projectile nose and the projectile segments. Upon the projectile assembly being fired from the firearm via the projectile casing, the projectile nose and projectile segments separate from one another upon subsequently exiting the firearm, thereby causing the projectile nose and projectile segments to radially separate from one another in flight toward an intended target.

18 Claims, 8 Drawing Sheets

(56) References Cited

U.S. PATENT DOCUMENTS

| | | | | |
|---|---|---|---|---|
| 3,862,600 | A * | 1/1975 | Tocco | F42B 5/03 102/438 |
| 3,877,381 | A * | 4/1975 | McCoy | F42B 7/04 102/501 |
| 4,603,637 | A * | 8/1986 | Snide | F42B 8/16 102/517 |
| 4,754,706 | A | 7/1988 | Fauvel et al. | |
| 5,020,437 | A | 6/1991 | Rieger et al. | |
| 6,021,716 | A | 2/2000 | Taylor | |
| 7,210,410 | B1 | 5/2007 | Widener | |
| 7,448,324 | B1 | 11/2008 | King et al. | |
| 7,707,941 | B2 | 5/2010 | Bishop et al. | |
| 8,307,768 | B2 * | 11/2012 | Cziglenyi | F42B 12/34 102/439 |
| 8,640,624 | B1 | 2/2014 | Hassan et al. | |
| 8,807,040 | B2 | 8/2014 | Menefee, III | |
| 9,103,640 | B2 | 8/2015 | Sexton | |
| 9,121,679 | B1 * | 9/2015 | Kim | F42B 8/12 |
| 9,506,731 | B2 | 11/2016 | Imhoff | |
| 9,568,292 | B2 | 2/2017 | Gevedon | |
| 9,599,444 | B2 * | 3/2017 | Rachlin | F42B 5/03 |
| 9,952,024 | B2 | 4/2018 | Sullivan et al. | |
| 10,330,448 | B2 * | 6/2019 | Muster | F42B 12/06 |
| 10,443,993 | B1 | 10/2019 | Chaplin et al. | |
| 10,584,947 | B1 | 3/2020 | Manley et al. | |
| 11,047,657 | B2 | 6/2021 | Garst et al. | |
| 11,118,865 | B2 | 9/2021 | Pigott et al. | |
| 11,156,442 | B1 | 10/2021 | Kampo et al. | |
| 11,976,907 | B2 | 5/2024 | Allison | |
| 2010/0282110 | A1 | 11/2010 | Sexton | |
| 2011/0146522 | A1 * | 6/2011 | Wonsewitz | F42B 5/035 102/438 |
| 2012/0234198 | A1 | 9/2012 | Carmel | |
| 2012/0266773 | A1 | 10/2012 | Eckstein | |
| 2017/0276463 | A1 * | 9/2017 | Tubb | F42B 5/067 |
| 2025/0137757 | A1 | 5/2025 | Allen | |
| 2026/0133018 | A1 | 5/2026 | Imhoff et al. | |

* cited by examiner

SEGMENTED PROJECTILE APPARATUS FOR FIREARMS

RELATED APPLICATIONS

This application claims priority and is entitled to the filing date of U.S. provisional application Ser. No. 63/887,584, filed on Sep. 25, 2025. The contents of the aforementioned application are incorporated herein by reference.

BACKGROUND

The subject of this patent application relates generally to projectiles, and more particularly to a segmented projectile apparatus capable of being loaded into and fired from any traditional, pre-existing firearm while also being configured for creating a shotgun-like spread.

Applicant hereby incorporates herein by reference any and all patents and published patent applications cited or referred to in this application.

By way of background, with drones becoming increasingly smaller and less expensive, the availability of and access to drones is also increasing. As a result, drones are becoming more widely used for surveillance, smuggling, and various other disruptive activities, which has given rise to the need to neutralize drones when such activities are unauthorized. Because radio-frequency jamming is not always legal, effective, or safe in every environment, there is a growing need for physical "projectile" options that can neutralize drones quickly and reliably.

Several types of anti-drone projectiles currently exist. Some such prior art projectiles are known as "entangling projectiles," which typically include shoulder-fired launchers or larger munition rounds that deploy a net or tether to entangle a drone's rotors, thereby incapacitating the drone. Other such prior art projectiles are known as "kinetic interceptors," such as specialized shotgun shells or small guided rounds designed to physically strike and destroy a drone. Other prior art projectiles utilize high-power microwave or electromagnetic munitions that disrupt drone electronics over an area; though these are less common and more specialized.

Using anti-drone projectiles comes with several challenges. The most significant is collateral safety: destroying or disabling a drone causes it to fall, which can injure people or damage property in populated areas. This concern is why entangling projectiles are often preferred for civilian settings. However, entangling projectiles typically require a specialized firearm to launch them, which increases the cost of, and limits access to, such solutions.

Effectiveness is another challenge: drones are small, fast and maneuverable, and swarms of drones can overwhelm single-shot kinetic interceptors. There are also logistical and cost considerations, since guided interceptors and expendable munitions can be expensive and may need to be stocked in large quantities for credible defense against multiple drones. In addition, these types of projectiles tend to have a shorter range because their natural spread increases drag, resulting in ineffective or erratic behavior at longer distances.

With respect to known prior art kinetic interceptors that are configured as specialized shotgun shells, unlike rifle or handgun cartridges that usually fire a single solid bullet, a shotgun shell is capable of firing many small projectiles (commonly referred to as a "shot"), which begin to spread outward as they travel downrange. As a result, the shooter does not need to be as precise as with a single projectile. The spreading shot pattern increases the chance of hitting a fast-moving or unpredictable target such as one or more drones, while also delivering energy across a relatively wider area so as to reduce over-penetration risks and prevent the smaller shot projectiles from traveling too far. However, use of such prior art shotgun shells nevertheless requires a firearm capable of firing them—namely, a shotgun—thereby increasing the cost of such prior art solutions, at least for users who do not already own a compatible shotgun. And, again, shotguns are generally shorter-range weapons. Though this can be somewhat managed with purposefully-designed loads for slower or less spread, shot spreads throughout travel following the shot, and eventually becomes ineffective simply by having the shot spread over such a wide area that only one or two projectiles may hit a given target at a large distance.

Thus, there remains a need for an effective anti-drone projectile that provides a shotgun-like spread, and that is also capable of being loaded into and fired from any traditional, pre-existing firearm. One significant benefit is that users need not carry specialized weapons and the ammunition may be relatively easily stored and transported, to be available for ready access as needed. It should be noted that the need for such a projectile can extend beyond anti-drone applications, and may be applicable and beneficial in any other scenario where there is a need for a "scatter" shot projectile using a firearm other than a shotgun.

Other aspects that fulfill these needs and provide further related advantages as described in the following summary.

It should be noted that the above background description includes information that may be useful in understanding the projectiles described herein. It is not an admission that any of the information provided herein is prior art or relevant to the subject matter herein, or that any publication specifically or implicitly referenced is prior art.

SUMMARY

Certain benefits are taught related to construction and use which give rise to the exemplary advantages described below.

The subject matter described herein solves the problems described above by providing a segmented projectile apparatus for firearms. In at least one embodiment, the apparatus provides a projectile casing and a projectile assembly frictionally positioned therewithin and providing a projectile nose and a plurality of projectile segments temporarily engageable with one another in axially aligned series. The projectile nose is frictionally positioned within a casing neck of the projectile casing and has a substantially ogive-shaped nose leading end and an opposing nose trailing end. Each of the projectile segments has a segment leading end and an opposing segment trailing end. The segment leading end of a forwardmost one of the projectile segments and the nose trailing end of the projectile nose have complementary surfaces, such that the segment leading end of the forwardmost one of the projectile segments is positionable in temporary abutting contact with the nose trailing end of the projectile nose. The segment leading end of each of an at least one trailing one of the projectile segments and the segment trailing end of an immediately preceding one of the projectile segments also have complementary surfaces, such that the segment leading end of each of the at least one trailing one of the projectile segments is positionable in temporary abutting contact with the segment trailing end of the immediately preceding one of the projectile segments. A volume of compressed propellant material is positioned substantially between a rearwardmost one of the projectile segments and a casing primer of the projectile casing, such that the propellant material and the casing neck of the projectile casing cooperate to assist with maintaining the temporary engagement between the projectile nose and the projectile segments. Upon the projectile assembly being fired from the firearm via the projectile casing, the projectile nose and projectile segments separate from one another upon subsequently exiting a barrel of the firearm, thereby causing the projectile nose and projectile segments to radially separate from one another in flight toward an intended target.

Other features and advantages will become apparent from the following more detailed description, taken in conjunction with the accompanying, illustrative and exemplary drawings.

The above described drawing figures illustrate aspects which are further defined in detail in the following description. Features, elements, and aspects that are referenced by the same numerals in different figures represent the same, equivalent, or similar features, elements, or aspects, in accordance with one or more embodiments.

DETAILED DESCRIPTION

Figure 1:
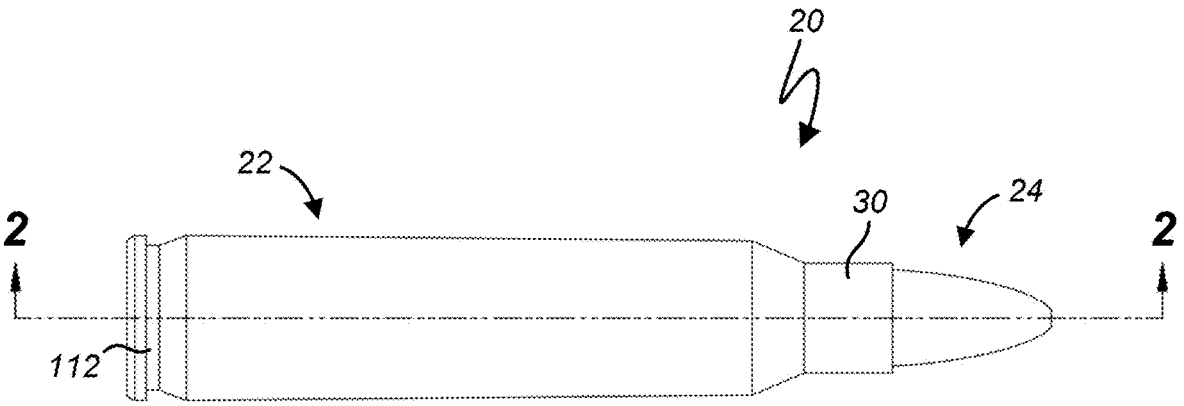
FIG. 1 is a side elevational view of an exemplary segmented projectile apparatus positioned within an exemplary projectile casing, in accordance with at least one embodiment.
Figure 2:
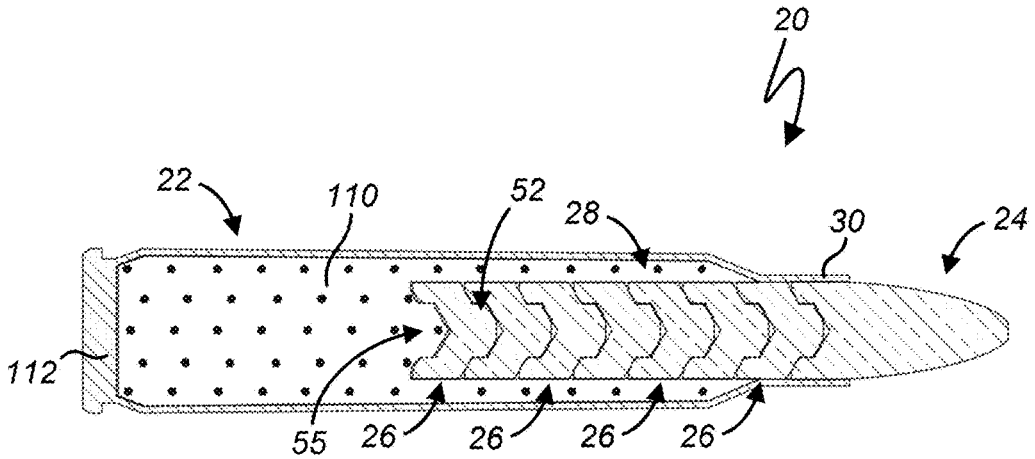
FIG. 2 is a cross-sectional view taken along line 2-2 of FIG. 1.

Turning now to FIGS. 1 and 2, there are shown a side elevational view and a side cross-sectional view, respectively, of an exemplary segmented projectile apparatus 20 positioned within an exemplary projectile casing 22 for use in a firearm, in accordance with at least one embodiment. At the outset, it should be noted that the embodiments of the apparatus 20 depicted in the drawings are merely exemplary and are shown for illustrative purposes. Accordingly, in further embodiments, the apparatus 20 (along with each of the components of the apparatus 20 described herein) may take on any other sizes, shapes, dimensions, configurations and/or quantities now known or later developed—dependent at least in part on the specific context in which the apparatus 20 is to be utilized, including but not limited to the specific type or caliber of firearm from which the apparatus 20 is to be fired—so long as the apparatus 20 is able to substantially carry out the functionality described herein.

Figure 3:
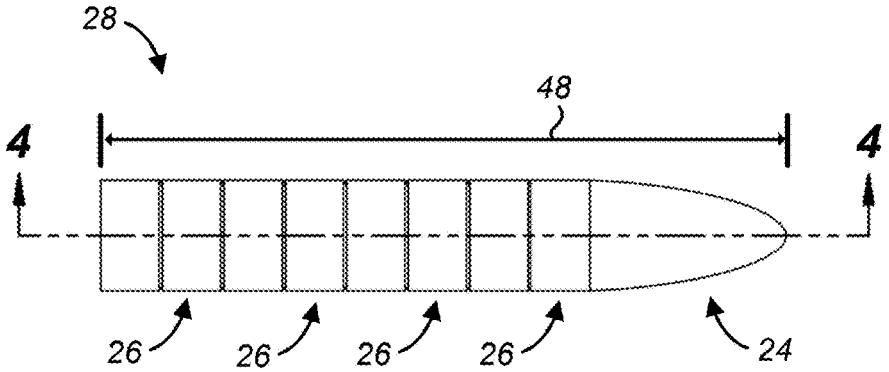
FIG. 3 is a further side elevational view of the apparatus, in accordance with at least one embodiment, with the exemplary casing omitted for clarity purposes.
Figure 4:
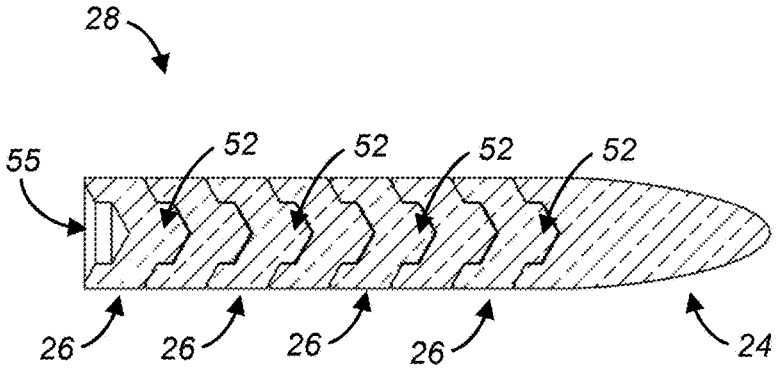
FIG. 4 is a cross-sectional view taken along line 4-4 of FIG. 3.
Figure 5:
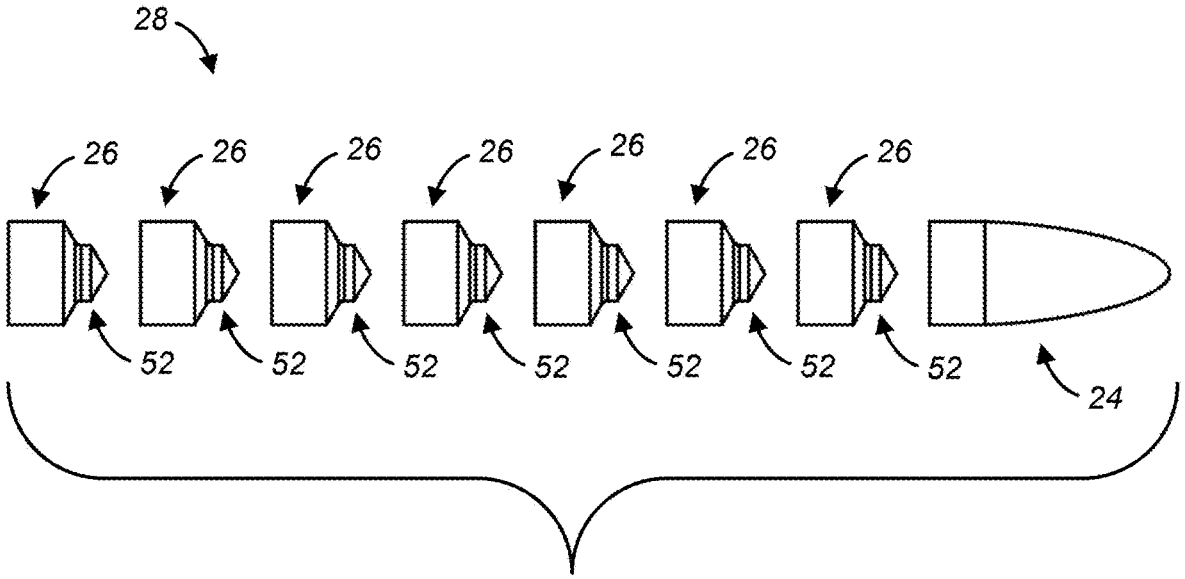
FIGS. 5 and 6 are exploded views of the apparatus of FIG. 3, in accordance with at least one embodiment.
Figure 6:
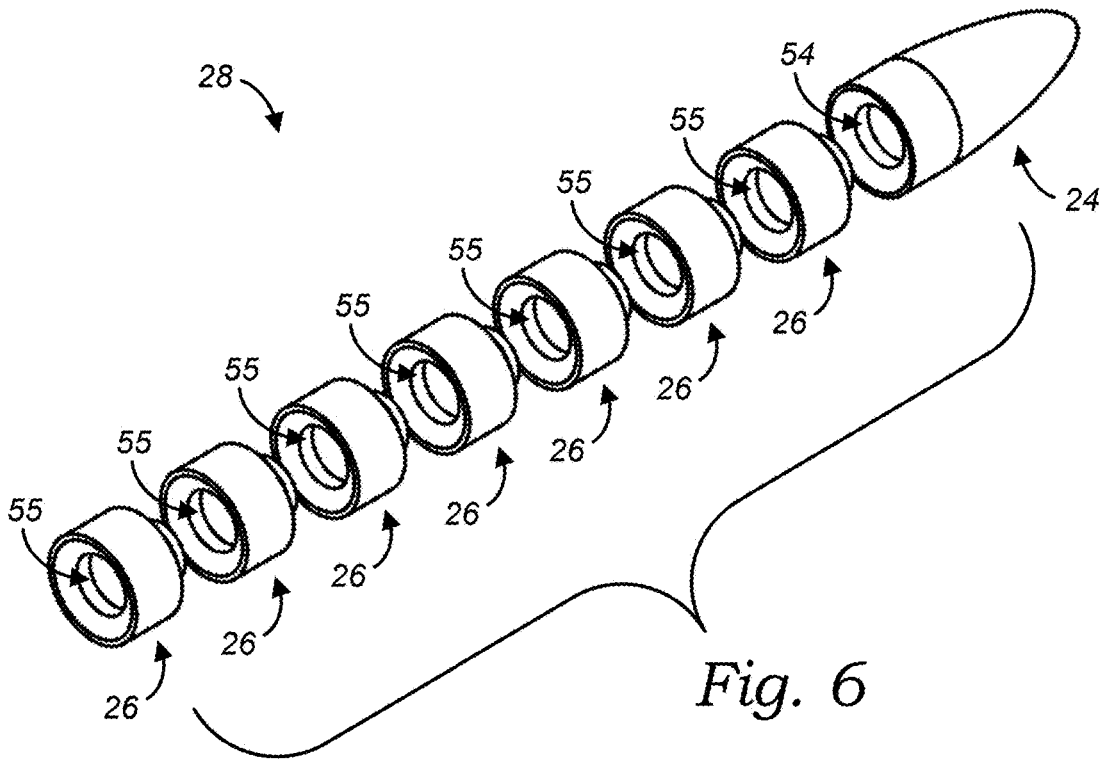

In at least one embodiment, as illustrated in FIGS. 3-5, the apparatus 20 provides a projectile nose 24 and an at least one projectile segment 26 temporarily engageable with one another in axially aligned series so as to form an overall projectile assembly 28 frictionally positioned within the projectile casing 22 prior to being fired from the corresponding firearm. In at least one embodiment, the projectile nose 24 is frictionally positioned within a casing neck 30 of the projectile casing 22, as illustrated in FIGS. 1 and 2. As discussed further below, the projectile nose 24 and at least one projectile segment 26 of the projectile assembly 28 are configured for remaining securely engaged with one another during transport and while being handled when loaded into the firearm via the projectile casing 22. The projectile nose 24 and at least one projectile segment 26 are further configured for separating from one another upon being fired from the projectile casing 22 and subsequently exiting a barrel of the firearm, such that the projectile nose 24 and at least one projectile segment 26 each then divert a distance away from the projectile assembly's 28 original line of flight toward an intended target (such as a drone, for example). In other words, the temporary engagement between each of the projectile nose 24 and the at least one projectile segment 26 is strong enough to maintain said engagement both prior to and after being loaded into the firearm, with said engagement only being overcome upon the projectile assembly 28 being fired from, and exiting the barrel of, the firearm. As a result, the target is impacted by the separated components of the projectile assembly 28 over a relatively wider area, similar to a shotgun shell, as compared to a single projectile. In at least one embodiment, the projectile casing 22 is a standard, traditional shell casing, thereby better ensuring that the apparatus 20 is capable of being loaded into and fired from any traditional, pre-existing firearm. However, in at least one alternate embodiment, the projectile casing 22 may take on any other sizes, shapes, dimensions and/or configurations, now known or later developed—dependent at least in part on the specific context in which the apparatus 20 is to be utilized, including but not limited to the specific type or caliber of firearm from which the apparatus 20 is to be fired—so long as the apparatus 20 is able to substantially carry out the functionality described herein.

Figure 7:
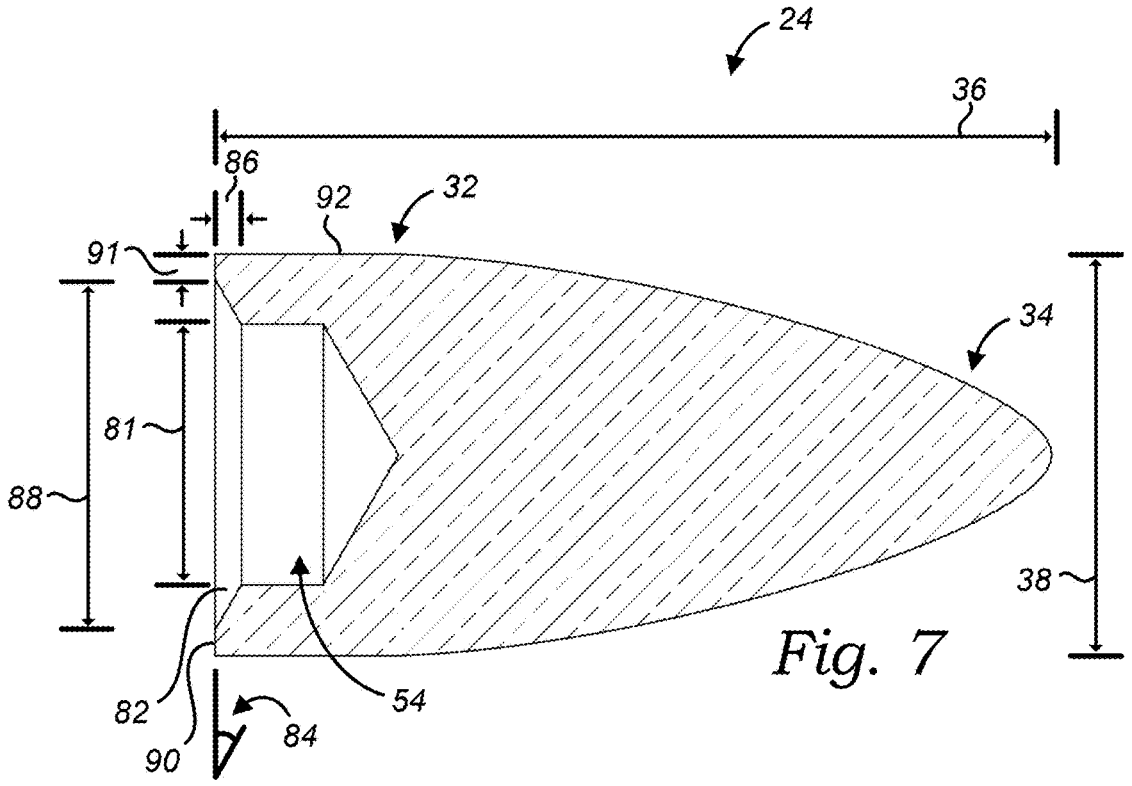
FIG. 7 is a detailed cross-sectional view of an exemplary projectile nose of the apparatus of FIG. 4.

In at least one embodiment, as best illustrated in FIGS. 5 and 7, a nose trailing end 32 of the projectile nose 24 is substantially cylindrical-shaped, while an opposing nose leading end 34 of the projectile nose 24 is substantially ogive-shaped. However, in further embodiments, each of the nose leading end 34 and nose trailing end 32 may have any other sufficiently aerodynamic or non-aerodynamic shape, now known or later developed, so long as the apparatus 20 is able to substantially carry out the functionality described herein. In at least one embodiment, the projectile nose 24 has a nose length 36 of approximately 0.5-1.0 inches. However, in at least one alternate embodiment, the projectile nose 24 may have a nose length 36 of less than 0.5 inches or greater than 1.0 inch—dependent at least in part on the specific context in which the apparatus 20 is to be utilized, including but not limited to the specific type or caliber of firearm from which the apparatus 20 is to be fired—so long as the apparatus 20 is able to substantially carry out the functionality described herein.

Additionally, in at least one embodiment, the nose trailing end 32 has a nose trailing diameter 38 of approximately 0.2-0.4 inches. However, in at least one alternate embodiment, the nose trailing end 32 may have a nose trailing diameter 38 of less than 0.2 inches or greater than 0.4 inches—dependent at least in part on the specific context in which the apparatus 20 is to be utilized, including but not limited to the specific type of firearm from which the apparatus 20 is to be fired—so long as the apparatus 20 is able to substantially carry out the functionality described herein.

Figure 8:
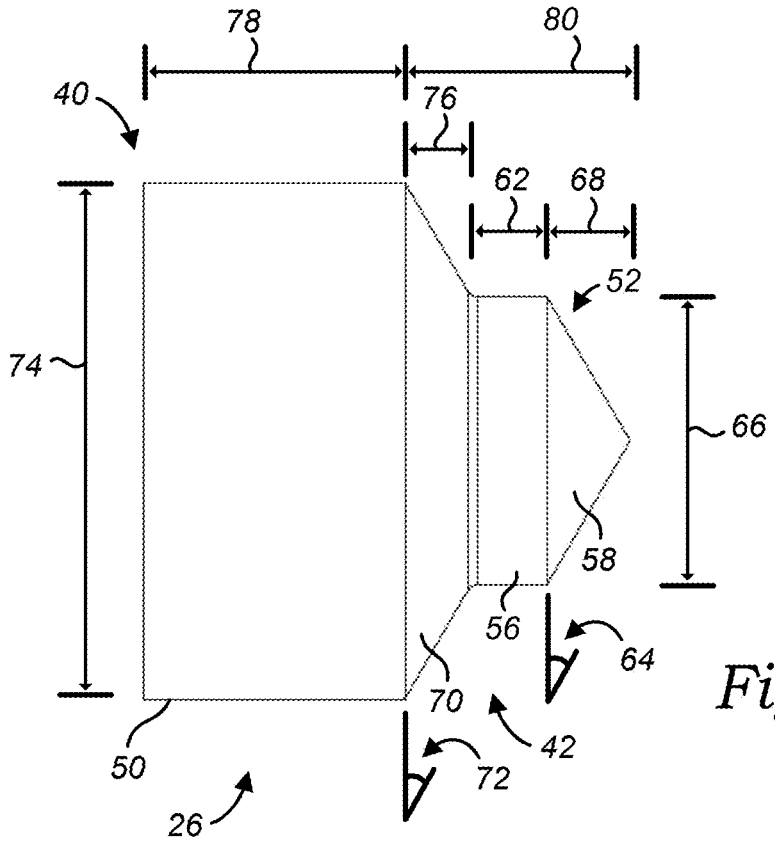
FIG. 8 is a side elevational view of an exemplary projectile segment of the apparatus of FIG. 3, in accordance with at least one embodiment.
Figure 9:
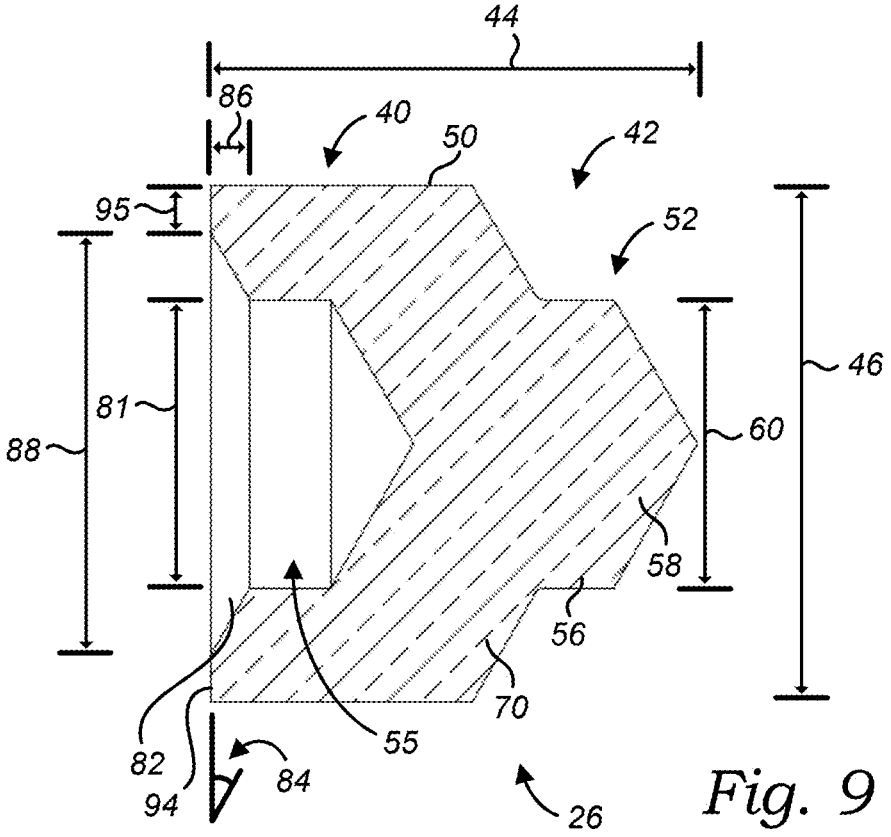
FIG. 9 is a detailed cross-sectional view of a projectile segment of the apparatus of FIG. 4.

In at least one embodiment, as best illustrated in FIGS. 8 and 9, a segment trailing end 40 of the at least one projectile segment 26 is substantially cylindrical-shaped, while an opposing segment leading end 42 of the at least one projectile segment 26 is configured for being positioned in temporary abutting contact with either the nose trailing end 32 of the projectile nose 24 (in the case of a forwardmost one of the at least one projectile segment 26, nearest to the projectile nose 24—hereinafter referred to as a "forwardmost projectile segment 26" for simplicity purposes) or the segment trailing end 40 of a further one of the at least one projectile segment 26 (in the case of a further one of the at least one projectile segment 26 positioned in series after the forwardmost projectile segment 26—hereinafter referred to as a "trailing projectile segment 26" for simplicity purposes). In other words, in at least one embodiment, the nose trailing end 32 of the projectile nose 24 and the segment leading end 42 of the at least one projectile segment 26 have complementary surfaces, while the segment trailing end 40 and the segment leading end 42 of the at least one projectile segment 26 likewise have complementary surfaces, so as to better facilitate temporary abutting contact therebetween. However, in further embodiments, each of the segment leading end 42 and segment trailing end 40 may have any other sufficiently aerodynamic shape, now known or later developed, so long as the apparatus 20 is able to substantially carry out the functionality described herein.

In at least one embodiment, the at least one projectile segment 26 has a segment length 44 (see, e.g., FIG. 9) that is relatively less than the nose length 36 (see, e.g., FIG. 7) of the projectile nose 24; however, in at least one alternate embodiment, the at least one projectile segment 26 has a segment length 44 that is substantially equal to or greater than the nose length 36 of the projectile nose 24. In at least one embodiment, the at least one projectile segment 26 has a segment length 44 of approximately 0.1-0.5 inches. However, in at least one alternate embodiment, one or more of the at least one projectile segment 26 may have a segment length 44 of less than 0.1 inches or greater than 0.5 inches—dependent at least in part on the specific context in which the apparatus 20 is to be utilized, including but not limited to the specific type of firearm from which the apparatus 20 is to be fired—so long as the apparatus 20 is able to substantially carry out the functionality described herein. In other words, in at least one embodiment, where the apparatus 20 provides a plurality of projectile segments 26, the segment length 44 of each projectile segment 26 is substantially the same; while in at least one alternate such embodiment, the segment length 44 of one or more of the projectile segments 26 is different. Additionally, in at least one embodiment, the segment trailing end 40 of the at least one projectile segment 26 has a segment trailing diameter 46 of approximately 0.2-0.4 inches. However, in at least one alternate embodiment, the segment trailing end 40 of one or more of the at least one projectile segment 26 may have a segment trailing diameter 46 of less than 0.2 inches or greater than 0.4 inches—dependent at least in part on the specific context in which the apparatus 20 is to be utilized, including but not limited to the specific type or caliber of firearm from which the apparatus 20 is to be fired—so long as the apparatus 20 is able to substantially carry out the functionality described herein. In at least one embodiment, the segment trailing diameter 46 of the at least one projectile segment 26 is the same as the nose trailing diameter 38 of the projectile nose 24, such that the projectile assembly 28 has a uniform outer diameter. However, in at least one alternate embodiment, the segment trailing diameter 46 of one or more of the at least one projectile segment 26 is different than the nose trailing diameter 38 of the projectile nose 24. In all embodiments, the nose trailing diameter 38 of the projectile nose 24 and the segment trailing diameter 46 (see, e.g., FIG. 9) of the at least one projectile segment 26 are each less than an inner diameter of the barrel of the corresponding firearm (i.e., the caliber of the firearm and corresponding projectile casing 22). Additionally, in at least one embodiment, the projectile assembly 28 has an assembly length 48 that is substantially the same as a length of a traditional projectile that is configured for being fired from the same firearm as the projectile assembly 28, thereby better ensuring that the projectile assembly 28 will be compatible with the firearm. However, in at least one alternate embodiment, the projectile assembly 28 may have an assembly length 48 that is less than or greater than the length of a traditional projectile that is configured for being fired from the same firearm as the projectile assembly 28.

Figure 10:
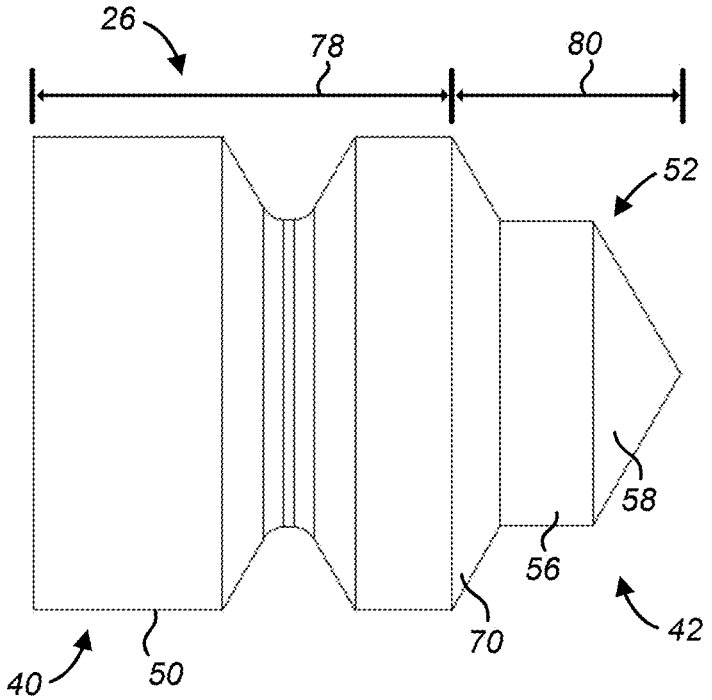
FIG. 10 is a side elevational view of a further exemplary projectile segment of the apparatus, in accordance with at least one embodiment.

In at least one embodiment, as illustrated in FIG. 8 for example, the segment trailing end 40 of the at least one projectile segment 26 has a substantially uniform segment trailing sidewall 50. In at least one alternate embodiment, as illustrated in FIG. 10 for example, the segment trailing end 40 of one or more of the at least one projectile segment 26 has a non-uniform segment trailing sidewall 50, which affects the trajectory of said at least one projectile segment 26 when the corresponding projectile assembly 28 is fired from the firearm. Thus, in further embodiments, the at least one projectile segment 26, may take on any other sizes, shapes, dimensions, configurations and/or quantities, now known or later developed—dependent at least in part on the specific context in which the apparatus 20 is to be utilized, including but not limited to the specific type of firearm from which the apparatus 20 is to be fired—so long as the apparatus 20 is able to substantially carry out the functionality described herein. The non-uniform segment trailing sidewall 50, as shown in FIG. 10, may have an aerodynamic function to encourage the individual projectile segments 26 to separate using drag acting upon the non-uniform segment trailing sidewall 50 or otherwise to cause the projectile segments 26 to have slightly-different weightings (for example, by shifting a center of gravity of the projectile segment 26 forward and a center of pressure backward, so as to better stabilize the projectile segment 26) or flight paths after they exit the barrel of the firearm. Similarly, in further embodiments, the projectile nose 24, may take on any other sizes, shapes, dimensions and/or configurations, now known or later developed—dependent at least in part on the specific context in which the apparatus 20 is to be utilized, including but not limited to the specific type of firearm from which the apparatus 20 is to be fired—so long as the apparatus 20 is able to substantially carry out the functionality described herein.

As discussed above, the projectile nose 24 and the at least one projectile segment 26 of the projectile assembly 28 are temporarily engageable with one another in axially aligned series, with that engagement persisting until the projectile assembly 28 is fired from, and subsequently exits the barrel of, the firearm, at which point the projectile nose 24 and the at least one projectile segment 26 separate from one another during flight. In at least one embodiment, as best illustrated in FIGS. 4-9, this temporary engagement is achieved by an engagement protrusion 52 provided by the segment leading end 42 of the at least one projectile segment 26, along with a corresponding rearwardly opening nose engagement cavity 54 and segment engagement cavity 55 provided by each of the nose trailing end 32 of the projectile nose 24 and the segment trailing end 40 of the at least one projectile segment 26, respectively. In at least one embodiment, the nose engagement cavity 54 of the nose trailing end 32 of the projectile nose 24 is coaxial with a longitudinal axis of the projectile nose 24, and is sized and configured for removably receiving the engagement protrusion 52 of the forwardmost projectile segment 26 so as to create a temporary frictional, press-fit engagement therebetween. Similarly, in at least one embodiment, the segment engagement cavity 55 of the segment trailing end 40 of each projectile segment 26 is coaxial with a longitudinal axis of the projectile segment 26, and is sized and configured for removably receiving the engagement protrusion 52 of the subsequent trailing projectile segment 26 so as to create a temporary frictional, press-fit engagement therebetween. Additionally, in at least one embodiment, each engagement protrusion 52 is coaxial with the longitudinal axis of the associated projectile segment 26. In at least one embodiment, the temporary frictional, press-fit engagement between each of the projectile nose 24 and at least one projectile segment 26 of the projectile assembly 28 is configured for being strong enough, and tight enough, to maintain the temporary engagement therebetween both prior to and after being loaded into the firearm, with said engagement only being overcome upon the projectile assembly 28 being fired from, and exiting the barrel of, the firearm; thereby causing the projectile nose 24 and the at least one projectile segment 26 to separate from one another in flight.

In at least one such embodiment, the engagement protrusion 52 of the at least one projectile segment 26 provides a protrusion base 56 on which is positioned a protrusion tip 58. In at least one embodiment, the protrusion base 56 is substantially cylindrical in shape; however, in further embodiments, the protrusion base 56 may have any other shape, now known or later developed, so long as the apparatus 20 is able to substantially carry out the functionality described herein. In at least one embodiment, the protrusion base 56 has a base diameter 60 of approximately 0.1-0.2 inches. However, in at least one alternate embodiment, the protrusion base 56 may have a base diameter 60 of less than 0.1 inches or greater than 0.2 inches, so long as the apparatus 20 is able to substantially carry out the functionality described herein. In at least one embodiment, the protrusion base 56 has a base diameter 60 that is approximately 25%-90% of the segment trailing diameter 46 of the at least one projectile segment 26. Additionally, in at least one embodiment, the protrusion base 56 has a base length 62 of approximately 0.01-0.1 inches. However, in at least one alternate embodiment, the protrusion base 56 may have a base length 62 of less than 0.01 inches or greater than 0.1 inches, so long as the apparatus 20 is able to substantially carry out the functionality described herein. In at least one embodiment, the protrusion tip 58 has a tapered, substantially conical shape; however, in further embodiments, the protrusion base 56 may have any other shape, now known or later developed, so long as the apparatus 20 is able to substantially carry out the functionality described herein. In at least one embodiment, the protrusion tip 58 has a tip angle 64 of approximately 60 degrees relative to the protrusion base 56. However, in at least one alternate embodiment, the protrusion tip 58 may have a tip angle 64 of less than 60 degrees or greater than 60 degrees relative to the protrusion base 56, so long as the apparatus 20 is able to substantially carry out the functionality described herein. Additionally, in at least one embodiment, the protrusion tip 58 has a tip diameter 66 of approximately 0.1-0.2 inches. However, in at least one alternate embodiment, the protrusion tip 58 may have a tip diameter 66 of less than 0.1 inches or greater than 0.2 inches, so long as the apparatus 20 is able to substantially carry out the functionality described herein. In at least one embodiment, the protrusion tip 58 has a tip length 68 of approximately 0.01-0.1 inches. However, in at least one alternate embodiment, the protrusion tip 58 may have a tip length 68 of less than 0.01 inches or greater than 0.1 inches, so long as the apparatus 20 is able to substantially carry out the functionality described herein.

In at least one embodiment, the engagement protrusion 52 of the at least one projectile segment 26 further provides a tapered protrusion shoulder 70 positioned and configured for creating a transition surface between the protrusion base 56 and the segment trailing sidewall 50 of the segment trailing end 40 of the projectile segment 26. In at least one embodiment, the protrusion shoulder 70 has a shoulder angle 72 of approximately 60 degrees relative to the segment trailing end 40. However, in at least one alternate embodiment, the protrusion shoulder 70 may have a shoulder angle 72 of less than 60 degrees or greater than 60 degrees relative to the segment trailing end 40, so long as the apparatus 20 is able to substantially carry out the functionality described herein. Additionally, in at least one embodiment, the protrusion shoulder 70 has a shoulder diameter 74 of approximately 0.1-0.2 inches. However, in at least one alternate embodiment, the protrusion shoulder 70 may have a shoulder diameter 74 of less than 0.1 inches or greater than 0.2 inches, so long as the apparatus 20 is able to substantially carry out the functionality described herein. In at least one embodiment, the protrusion shoulder 70 has a shoulder length 76 of approximately 0.01-0.1 inches. However, in at least one alternate embodiment, the protrusion shoulder 70 may have a shoulder length 76 of less than 0.01 inches or greater than 0.1 inches, so long as the apparatus 20 is able to substantially carry out the functionality described herein. By way of non-limiting example, the following table illustrates exemplary dimensions of the engagement protrusion 52 for select firearms of varying calibers. These exemplary dimensions are intended to be a mere subset of all possible dimensions for the engagement protrusion 52 and so should not be construed to limit any of the embodiments described herein.

Exemplary Engagement Protrusion Dimensions

| Firearm Caliber | Base Diameter (60) | Base Length (62) | Tip Angle (64) | Tip Diameter (66) | Tip Length (68) | Shoulder Angle (72) | Shoulder Diameter (74) | Shoulder Length (76) |
|---|---|---|---|---|---|---|---|---|
| 9 × 19 mm | 0.200" | 0.035" | 30° | 0.200" | 0.030" | 30° | 0.355" | 0.021" |
| 556 × 45 mm | 0.125" | 0.035" | 30° | 0.125" | 0.030" | 30° | 0.224" | 0.029" |
| 6.8 × 51 mm | 0.200" | 0.035" | 30° | 0.200" | 0.030" | 30° | 0.277" | 0.024" |
| 7.62 × 39 mm | 0.200" | 0.035" | 30° | 0.200" | 0.030" | 30° | 0.308" | 0.032" |
| 7.62 × 51 mm | 0.200" | 0.035" | 30° | 0.200" | 0.030" | 30° | 0.308" | 0.032" |
| 12.7 × 99 mm | 0.350" | 0.045" | 30° | 0.350" | 0.040" | 30° | 0.510" | 0.046" |
| 20 × 102 mm | 0.625" | 0.065" | 30° | 0.625" | 0.060" | 30° | 0.787" | 0.047" |

In at least one embodiment, the segment trailing end 40 of the at least one projectile segment 26 has a trailing end length 78 of approximately 0.1-0.3 inches. However, in at least one alternate embodiment, the segment trailing end 40 of one or more of the at least one projectile segment 26 may have a trailing end length 78 of less than 0.1 inches or greater than 0.3 inches, so long as the apparatus 20 is able to substantially carry out the functionality described herein. In at least one embodiment, the segment trailing end 40 of the at least one projectile segment 26 has a trailing end length 78 that is approximately 50%-300% of the shoulder diameter 74 of said projectile segment 26. In at least one embodiment, where the apparatus 20 provides a plurality of projectile segments 26, the trailing end length 78 of the segment trailing end 40 of each projectile segment 26 is substantially the same; while in at least one alternate such embodiment, the trailing end length 78 of the segment trailing end 40 of one or more of the projectile segments 26 is different. Similarly, in at least one embodiment, the segment leading end 42 of the at least one projectile segment 26 has a leading end length 80 of approximately 0.03-0.3 inches. However, in at least one alternate embodiment, the segment leading end 42 of one or more of the at least one projectile segment 26 may have a leading end length 80 of less than 0.03 inches or greater than 0.3 inches, so long as the apparatus 20 is able to substantially carry out the functionality described herein. In other words, in at least one embodiment, where the apparatus 20 provides a plurality of projectile segments 26, the leading end length 80 of the segment leading end 42 of each projectile segment 26 is substantially the same; while in at least one alternate such embodiment, the leading end length 80 of the segment leading end 42 of one or more of the projectile segments 26 is different. Accordingly, in at least one embodiment, where the apparatus 20 provides a plurality of projectile segments 26, the engagement protrusion 52 of each projectile segment 26 is substantially the same; while in at least one alternate such embodiment, the engagement protrusion 52 of one or more of the projectile segments 26 is different. By way of non-limiting example, the following table illustrates exemplary dimensions of the apparatus 20 for select firearms of varying calibers. These exemplary dimensions are intended to be a mere subset of all possible dimensions for the apparatus 20 and so should not be construed to limit any of the embodiments described herein.

Exemplary Apparatus Dimensions

| Firearm Caliber | Assembly Length (48) | Nose Length (36) | Nose Trailing Diameter (38) | Segment Length (44) | Segment Trailing Diameter (46) | Trailing End Length (78) | Leading End Length (80) |
|---|---|---|---|---|---|---|---|
| 9 × 19 mm | 1.250" | 0.400" | 0.355" | 0.125" | 0.355" | 0.125" | 0.125" |
| 556 × 45 mm | 1.400 | 0.400" | 0.224" | 0.250" | 0.224" | 0.125" | 0.125" |
| 6.8 × 51 mm | 1.850" | 0.600" | 0.277" | 0.325" | 0.277" | 0.250" | 0.125" |
| 7.62 × 39 mm | 2.000" | 0.600" | 0.308" | 0.325" | 0.308" | 0.250" | 0.125" |
| 7.62 × 51 mm | 2.000" | 0.600" | 0.308" | 0.325" | 0.308" | 0.250" | 0.125" |
| 12.7 × 99 mm | 4.500" | 1.000" | 0.510" | 0.510" | 0.510" | 0.375" | 0.125" |
| 20 × 102 mm | 5.000" | 2.000" | 0.787" | 1.000" | 0.787" | 0.750" | 0.250" |

As noted above, in at least one embodiment, the nose engagement cavity 54 of the nose trailing end 32 of the projectile nose 24 is sized and configured for removably receiving the engagement protrusion 52 of the forwardmost projectile segment 26 so as to create a temporary frictional, press-fit engagement therebetween, while the segment engagement cavity 55 of the segment trailing end 40 of each projectile segment 26 is sized and configured for removably receiving the engagement protrusion 52 of the subsequent trailing projectile segment 26 so as to create a temporary frictional, press-fit engagement therebetween. In at least one such embodiment, as best illustrated in FIGS. 7 and 9, one or both of the nose engagement cavity 54 and segment engagement cavity 55 of each projectile segment 26 is configured for closely approximating the size, shape and dimensions of the corresponding engagement protrusion 52. In at least one embodiment, one or both of the nose engagement cavity 54 and segment engagement cavity 55 have a cavity diameter 81 of approximately 0.1-0.2 inches. However, in at least one alternate embodiment, one or both of the nose engagement cavity 54 and segment engagement cavity 55 may have a cavity diameter 81 of less than 0.1 inches or greater than 0.2 inches—depending on the dimensions of the corresponding engagement protrusion 52—so long as the apparatus 20 is able to substantially carry out the functionality described herein. In at least one embodiment, the tolerance between the cavity diameter 81 and the base diameter 60 of the corresponding engagement protrusion 52 is approximately 0.002 inches (i.e., the cavity diameter 81 is approximately 0.002 inches larger than the base diameter 60 of the corresponding engagement protrusion 52. However, in at least one alternate embodiment, the tolerance between the cavity diameter 81 and the base diameter 60 of the corresponding engagement protrusion 52 may be less than 0.002 inches or greater than 0.002 inches—for example, from approximately 0.01-0.0001 inches—so long as the apparatus 20 is able to substantially carry out the functionality described herein. In some cases, the engagement protrusion may incorporate an engagement lip of a larger diameter than the base diameter 60 for engagement with a counterpart circumferential engagement lip of a corresponding difference in diameter within the engagement cavity 54. However, in at least one alternate embodiment, one or both of the nose engagement cavity 54 and segment engagement cavity 55 of the at least one projectile segment 26 may have a size, shape and/or dimensions that are relatively larger than the corresponding engagement protrusion 52, so as to create pockets of space between select portions of the engagement protrusion 52 and the nose engagement cavity 54 or segment engagement cavity 55, thereby assisting in the subsequent separation between the components when the projectile assembly 28 is fired from the firearm. For example, in at least one such alternate embodiment, where the protrusion tip 58 of the engagement protrusion 52 has a substantially conical shape, the corresponding nose engagement cavity 54 or segment engagement cavity 55 may have a substantially uniform cylindrical shape.

In at least one embodiment, with continued referenced to FIGS. 7 and 9, to further assist in the subsequent separation between the components when the projectile assembly 28 is fired from the firearm, a circumferential edge of one or both of the nose engagement cavity 54 or segment engagement cavity 55 of each projectile segment 26 provides a circumferential cavity chamfer 82 configured for preventing the projectile nose 24 and the at least one projectile segment 26 from galling or fusing together upon being fired from the firearm. In at least one such embodiment, the cavity chamfer 82 is configured for closely approximating the size, shape and dimensions of the protrusion shoulder 70 of the corresponding engagement protrusion 52. However, in at least one alternate embodiment, the cavity chamfer 82 may have a different size, shape and/or dimensions as compared to the protrusion shoulder 70 of the corresponding engagement protrusion 52, so long as the apparatus 20 is able to substantially carry out the functionality described herein. In at least one embodiment, the cavity chamfer 82 has a chamfer angle 84 of approximately 60 degrees relative to nose trailing end 32 (with respect to the cavity chamfer 82 of the projectile nose 24) or the segment trailing end 40 of the corresponding projectile segment 26 (with respect to the cavity chamfer 82 of the at least one projectile segment 26). However, in at least one alternate embodiment, the cavity chamfer 82 may have a chamfer angle 84 of less than 60 degrees or greater than 60 degrees, so long as the apparatus 20 is able to substantially carry out the functionality described herein. Additionally, in at least one embodiment, the cavity chamfer 82 has a chamfer length 86 of approximately 0.01-0.1 inches. However, in at least one alternate embodiment, the cavity chamfer 82 may have a chamfer length 86 of less than 0.01 inches or greater than 0.1 inches, so long as the apparatus 20 is able to substantially carry out the functionality described herein.

In at least one embodiment, with continued reference to FIGS. 7 and 9, the cavity chamfer 82 of the projectile nose 24 has a chamfer diameter 88 that is relatively smaller than the nose trailing diameter 38 of the projectile nose 24. As a result, in at least one such embodiment, the nose trailing end 32 provides a nose trailing perimeter face 90 between the cavity chamfer 82 and a nose trailing sidewall 92 of the nose trailing end 32. In at least one embodiment, the nose trailing perimeter face 90 is oriented substantially normal to the nose trailing sidewall 92. In at least one embodiment, the nose trailing perimeter face 90 has a nose trailing perimeter face width 91 of approximately 0.01-0.05 inches. However, in at least one alternate embodiment, the nose trailing perimeter face 90 may have a nose trailing perimeter face width 91 of less than 0.01 inches or greater than 0.05 inches, so long as the apparatus 20 is able to substantially carry out the functionality described herein. Additionally, in at least one embodiment, the chamfer diameter 88 of the cavity chamfer 82 of the projectile nose 24 is also relatively smaller than the shoulder diameter 74 of the protrusion shoulder 70 of the forwardmost projectile segment 26, thereby creating a circumferential engagement gap 89 between the nose trailing perimeter face 90 and the protrusion shoulder 70 of the forwardmost projectile segment 26 so as to further assist in the subsequent separation between the components when the projectile assembly 28 is fired from the firearm. In at least one embodiment, the engagement gap 89 between the nose trailing perimeter face 90 and the protrusion shoulder 70 of the forwardmost projectile segment 26 has a gap distance 93 of approximately 0.010-0.050 inches. However, in at least one alternate embodiment, the gap distance 93 may be less than 0.010 inches or greater than 0.050 inches, so long as the apparatus 20 is able to substantially carry out the functionality described herein. Similarly, in at least one embodiment, the cavity chamfer 82 of the at least one projectile segment 26 has a chamfer diameter 88 that is relatively smaller than the segment trailing diameter 46 of the projectile segment 26. As a result, in at least one such embodiment, the segment trailing end 40 provides a segment trailing perimeter face 94 between the cavity chamfer 82 and the segment trailing sidewall 50 of the segment trailing end 40. In at least one embodiment, the segment trailing perimeter face 94 is oriented substantially normal to the segment trailing sidewall 50. In at least one embodiment, the segment trailing perimeter face 94 has a segment trailing perimeter face width 95 of approximately 0.01-0.05 inches. However, in at least one alternate embodiment, the segment trailing perimeter face 94 may have a segment trailing perimeter face width 95 of less than 0.01 inches or greater than 0.05 inches, so long as the apparatus 20 is able to substantially carry out the functionality described herein. Additionally, in at least one embodiment, the chamfer diameter 88 of the cavity chamfer 82 of the at least one projectile segment 26 is also relatively smaller than the shoulder diameter 74 of the protrusion shoulder 70 of the subsequent trailing projectile segment 26, thereby creating a circumferential engagement gap 89 between the segment trailing perimeter face 94 and the protrusion shoulder 70 of the subsequent trailing projectile segment 26 so as to further assist in the subsequent separation between the components when the projectile assembly 28 is fired from the firearm. In at least one embodiment, the engagement gap 89 between the segment trailing perimeter face 94 and the protrusion shoulder 70 of the subsequent trailing projectile segment 26 has a gap distance 93 of approximately 0.010-0.050 inches. However, in at least one alternate embodiment, the gap distance 93 may be less than 0.010 inches or greater than 0.050 inches, so long as the apparatus 20 is able to substantially carry out the functionality described herein. In at least one embodiment, the gap distance 93 between each of the projectile nose 24 and the at least one projectile segment 26 of the projectile assembly 28 is substantially the same; however, in at least one alternate embodiment, the gap distance 93 between one or more of the projectile nose 24 and the at least one projectile segment 26 of the projectile assembly 28 may vary. By way of non-limiting example, the following table illustrates exemplary dimensions of the cavity chamfer 82 of the projectile nose 24 and at least one projectile segment 26 for select firearms of varying calibers. These exemplary dimensions are intended to be a mere subset of all possible dimensions for the cavity chamfer 82 and so should not be construed to limit any of the embodiments described herein.

Exemplary Cavity Chamfer Dimensions

| Firearm Caliber | Cavity Diameter (81) | Chamfer Angle (84) | Chamfer Length (86) | Chamfer Diameter (88) | Nose Trailing Perimeter Face Width (91) | Segment Trailing Perimeter Face Width (95) | Gap Distance (93) |
|---|---|---|---|---|---|---|---|
| 9 × 19 mm | 0.200" | 30° | 0.020" | 0.275" | 0.020" | 0.020" | 0.012" |
| 556 × 45 mm | 0.125" | 30° | 0.020" | 0.184" | 0.020" | 0.020" | 0.012" |
| 6.8 × 51 mm | 0.200" | 30° | 0.035" | 0.237" | 0.020" | 0.020" | 0.012" |
| 7.62 × 39 mm | 0.200" | 30° | 0.035" | 0.268" | 0.020" | 0.020" | 0.012" |
| 7.62 × 51 mm | 0.200" | 30° | 0.035" | 0.268" | 0.020" | 0.020" | 0.012" |
| 12.7 × 99 mm | 0.400" | 30° | 0.050" | 0.470" | 0.020" | 0.020" | 0.012" |
| 20 × 102 mm | 0.625" | 30° | .0625" | 0.747" | 0.020" | 0.020" | 0.012" |

Figure 12:
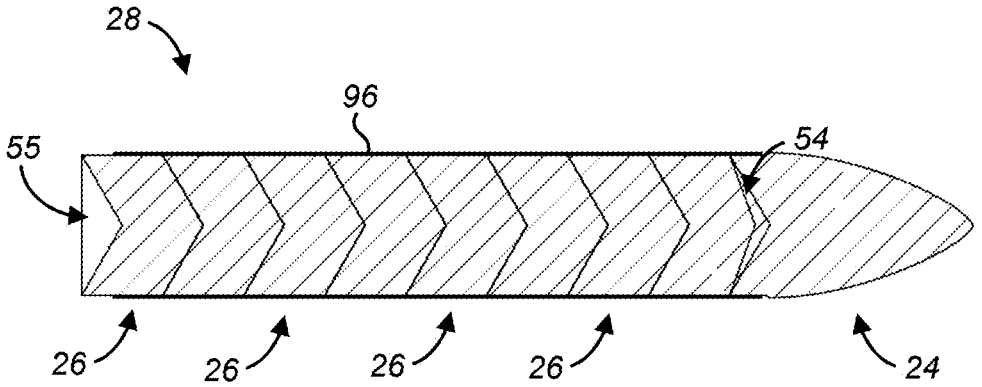
FIG. 12 is a cross-sectional view taken along line 12-12 of FIG. 11.
Figure 15:
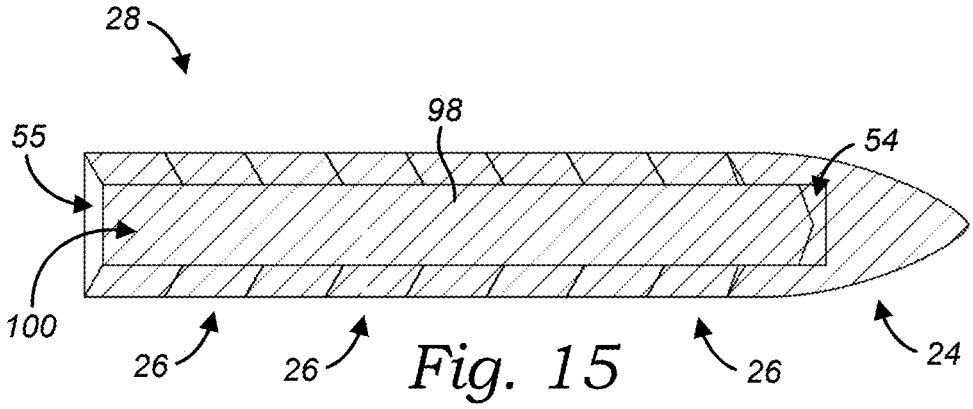
FIG. 15 is a cross-sectional view taken along line 15-15 of FIG. 14.

In further embodiments, the complementary surfaces between abutting ones of the projectile nose 24 and projectile segments 26 may take on any other sizes, shapes, dimensions and/or configurations, now known or later developed, so long as the apparatus 20 is able to substantially carry out the functionality described herein. Further examples of such complementary surfaces are illustrated in FIGS. 12 and 15, as discussed further below. Similarly, the apparatus 20 may utilize other structures and/or materials, now known or later developed, to achieve the desired temporary engagement between projectile nose 24 and the at least one projectile segment 26 of the projectile assembly 28, as also discussed further below.

Figure 11:
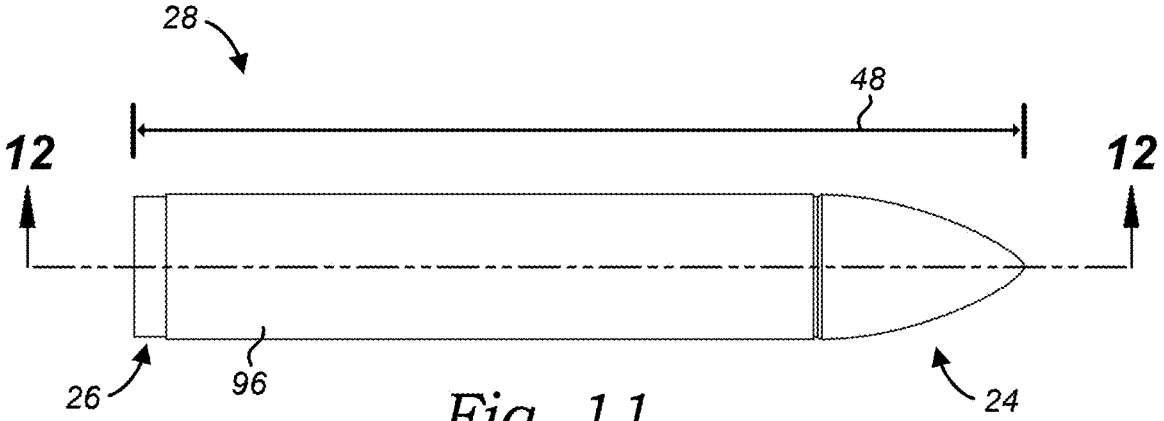
FIG. 11 is a side elevational view of a further exemplary segmented projectile apparatus, in accordance with at least one embodiment, with the exemplary casing omitted for clarity purposes.
Figure 13:
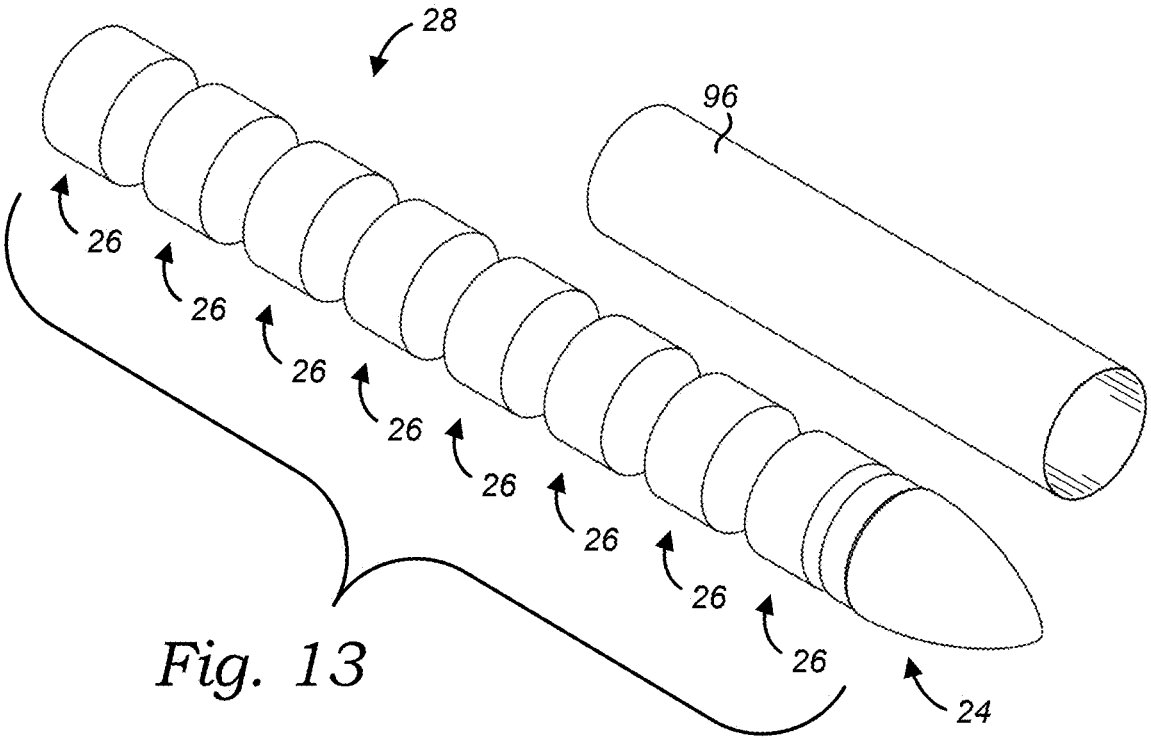
FIG. 13 is an exploded view of the apparatus of FIG. 11, in accordance with at least one embodiment.

In at least one alternate embodiment, as best illustrated in FIGS. 11-13, the temporary engagement between the projectile nose 24 and the at least one projectile segment 26 of the projectile assembly 28 is achieved by a temporary adhesive material positioned between one or more of the projectile nose 24 and the at least one projectile segment 26 of the projectile assembly 28. In at least one such embodiment, the temporary adhesive material is positioned on the segment leading end 42 of the at least one projectile segment 26, such that the temporary adhesive material is positioned between the segment leading end 42 of the at least one projectile segment 26 and the corresponding nose trailing end 32 of the projectile nose 24 or the segment trailing end 40 of a further at least one projectile segment 26 of the projectile assembly 28. In at least one embodiment, the temporary adhesive material is configured for being strong enough to maintain the temporary engagement between the projectile nose 24 and the at least one projectile segment 26 of the projectile assembly 28 both prior to and after being loaded into the firearm, with said engagement only being overcome upon the projectile assembly 28 being fired from, and exiting the barrel of, the firearm; thereby causing the projectile nose 24 and the at least one projectile segment 26 to separate from one another in flight. In other words, in at least one such embodiment, the temporary adhesive material is configured for breaking down or otherwise breaking apart from the percussive force of the projectile assembly 28 being fired from the firearm. In at least one embodiment, the temporary adhesive material is comprised of one or more of epoxy, cyanoacrylates, polyurethanes, or acrylics. However, in at least one alternate embodiment, the temporary adhesive material may be comprised of any other material (or combination of materials) now known or later developed—dependent at least in part on the specific context in which the apparatus 20 is to be utilized, including but not limited to the specific type of firearm from which the apparatus 20 is to be fired—so long as the apparatus 20 is able to substantially carry out the functionality described herein.

In at least one further alternate embodiment, as also best illustrated in FIGS. 11-13, the temporary engagement between the projectile nose 24 and the at least one projectile segment 26 of the projectile assembly 28 is achieved by a projectile sabot 96 sized and configured for temporarily encompassing the projectile nose 24 and the at least one projectile segment 26 of the projectile assembly 28, so as to temporarily retain the projectile nose 24 and the at least one projectile segment 26 in substantially axially aligned abutting contact. In at least one embodiment, the projectile sabot 96 is sized and configured for tightly conforming to an outer shape of the projectile assembly 28 (as defined by the nose trailing sidewall 92 of the projectile nose 24 and the segment trailing sidewall 50 of the at least one projectile segment 26). Additionally, in at least one embodiment, the projectile sabot 96 is configured for breaking down or otherwise breaking apart from the percussive force of the projectile assembly 28 being fired from the firearm; thereby causing the projectile nose 24 and the at least one projectile segment 26 to separate from one another in flight. In at least one embodiment, the projectile sabot 96 is constructed out of at least one of soft metals such as brass, copper or aluminum as well as polycarbonates, polypropylene, polyethylene, acrylonitrile butadiene styrene, nylon, acetal and acrylics. However, in at least one alternate embodiment, the projectile sabot 96 may be constructed out of any other material (or combination of materials) now known or later developed—dependent at least in part on the specific context in which the apparatus 20 is to be utilized, including but not limited to the specific type of firearm from which the apparatus 20 is to be fired—so long as the apparatus 20 is able to substantially carry out the functionality described herein.

Figure 14:
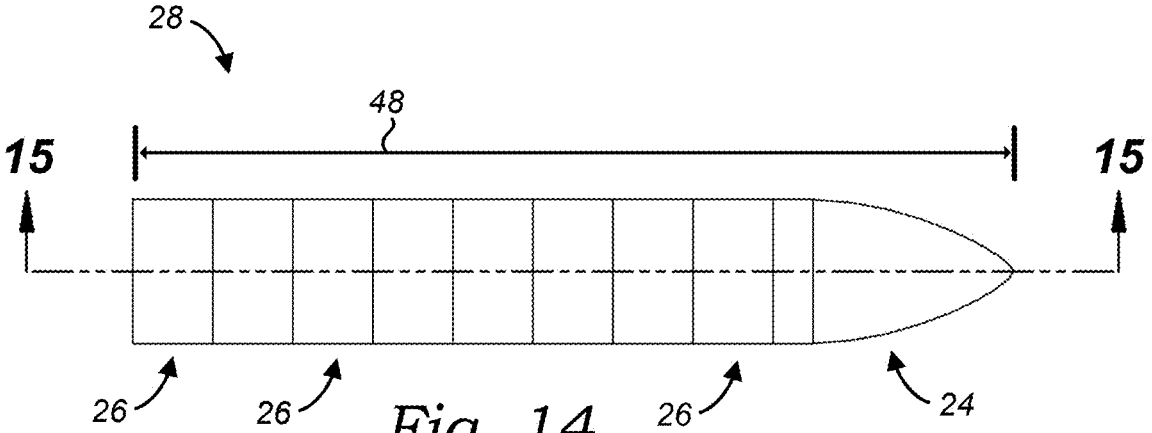
FIG. 14 is a side elevational view of a still further exemplary segmented projectile apparatus, in accordance with at least one embodiment, with the exemplary casing omitted for clarity purposes.
Figure 16:
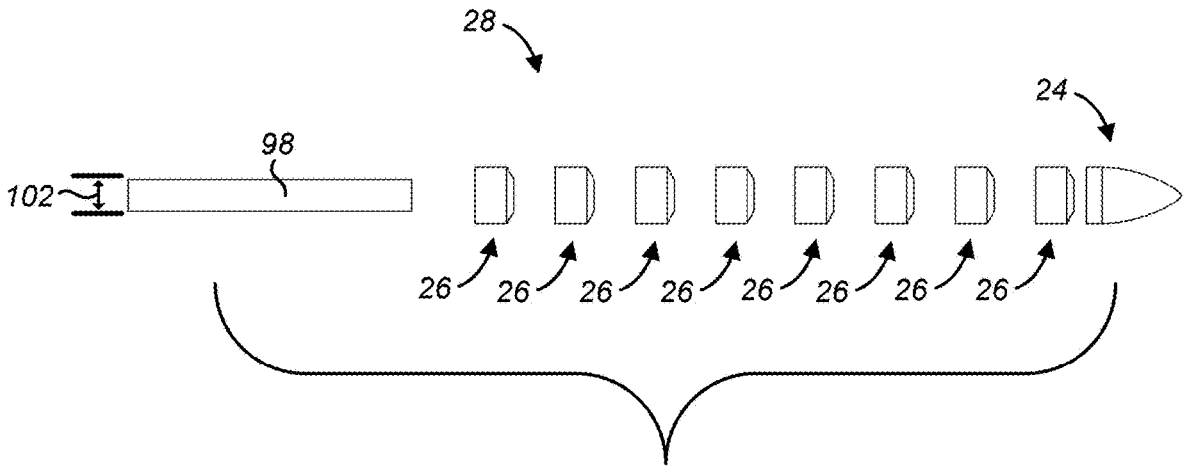
FIG. 16 is an exploded view of the apparatus of FIG. 14, in accordance with at least one embodiment.

In at least one still further alternate embodiment, as best illustrated in FIGS. 14-16, the temporary engagement between the projectile nose 24 and the at least one projectile segment 26 of the projectile assembly 28 is achieved by an at least one elongate connector shaft 98 extending coaxially through each of the projectile nose 24 and the at least one projectile segment 26 of the projectile assembly 28. In at least one such embodiment, the at least one projectile segment 26 defines a connector passage 100 extending coaxially through the at least one projectile segment 26, with the connector passage 100 sized for receiving the at least one connector shaft 98 therewithin. Accordingly, in at least one embodiment, the at least one connector shaft 98 extends from the nose engagement cavity 54 of the nose trailing end 32 of the projectile nose 24, through each of the at least one projectile segment 26, and terminates within a rearwardmost trailing projectile segment 26, furthest from the projectile nose 24—hereinafter referred to as a "rearwardmost projectile segment 26" for simplicity purposes. In at least one alternate embodiment, one or more of the at least one connector shaft 98 may extend non-coaxially through each of the projectile nose 24 and the at least one projectile segment 26 of the projectile assembly 28. In such alternate embodiments, the corresponding connector passage 100 of the at least one projectile segment 26 is likewise positioned so as to extend non-coaxially through said projectile segment 26. In at least one such alternate embodiment, the projectile assembly 28 provides two or more connector shafts 98 radially arranged within, and extending through, the projectile nose 24 and the at least one projectile segment 26 of the projectile assembly 28. In at least one embodiment, the connector shaft 98 has a shaft diameter 102 that closely approximates an inner diameter of each of the nose engagement cavity 54 of the nose trailing end 32 of the projectile nose 24 and the connector passage 100 of the at least one projectile segment 26, so as to create a frictional engagement therebetween. In at least one embodiment, the at least one connector shaft 98 has a shaft diameter 102 of approximately 0.010-0.125 inches. However, in at least one alternate embodiment, one or more of the at least one connector shaft 98 may have a shaft diameter 102 of less than 0.010 inches or greater than 0.125 inches, so long as the apparatus 20 is able to substantially carry out the functionality described herein. By way of non-limiting example, the following table illustrates exemplary dimensions of the at least one connector shaft 98 for select firearms of varying calibers. These exemplary dimensions are intended to be a mere subset of all possible dimensions for the at least one connector shaft 98 and so should not be construed to limit any of the embodiments described herein.

Exemplary Connector Shaft Dimensions

| Firearm Caliber | Shaft Diameter (102) |
|---|---|
| 9 × 19 mm | 0.125" |
| 556 × 45 mm | 0.100" |
| 6.8 × 51 mm | 0.125" |
| 7.62 × 39 mm | 0.125" |
| 7.62 × 51 mm | 0.125" |
| 12.7 × 99 mm | 0.125" |
| 20 × 102 mm | 0.250" |

Additionally, in at least one embodiment, the connector shaft 98 is configured for breaking down or otherwise breaking apart from the percussive force of the projectile assembly 28 being fired from the firearm; thereby causing the projectile nose 24 and the at least one projectile segment 26 to separate from one another in flight. In at least one embodiment, the at least one connector shaft 98 is constructed out of at least one of soft metals such as brass, copper or aluminum as well as polycarbonates, polypropylene, polyethylene, acrylonitrile butadiene styrene, nylon, acetal and acrylics. However, in at least one alternate embodiment, the at least one connector shaft 98 may be constructed out of any other material (or combination of materials) now known or later developed—dependent at least in part on the specific context in which the apparatus 20 is to be utilized, including but not limited to the specific type of firearm from which the apparatus 20 is to be fired—so long as the apparatus 20 is able to substantially carry out the functionality described herein. Similarly, in at least one alternate embodiment, the at least one connector shaft 98 may take on any other sizes, shapes, dimensions, configurations, quantities and/or arrangements, now known or later developed, so long as the apparatus 20 is able to substantially carry out the functionality described herein.

Figure 17:
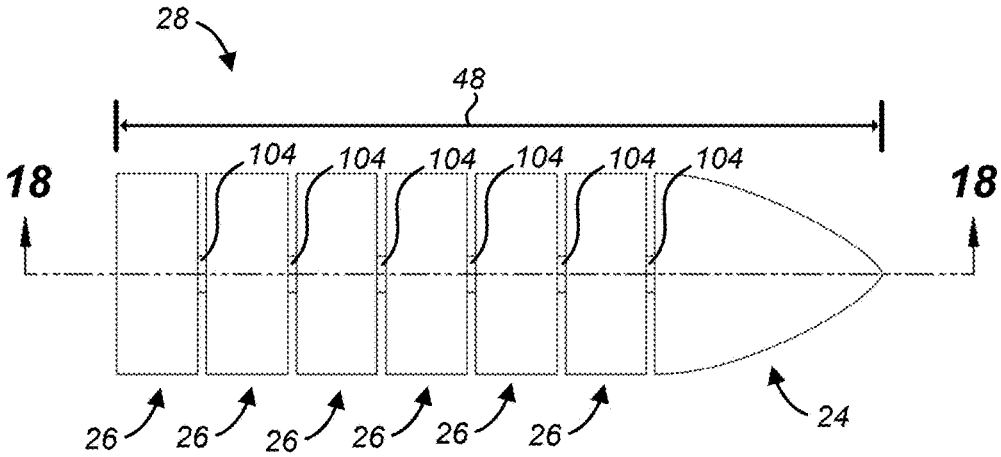
FIG. 17 is a side elevational view of a still further exemplary segmented projectile apparatus, in accordance with at least one embodiment, with the exemplary casing omitted for clarity purposes.
Figure 18:
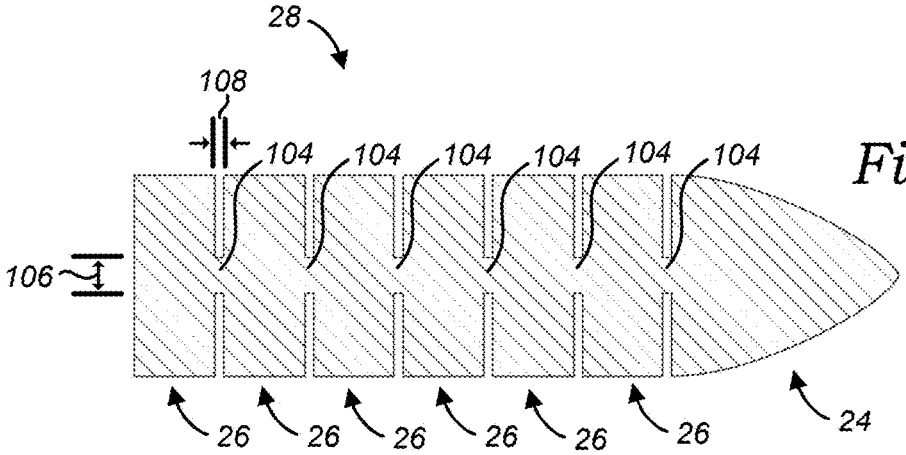
FIG. 18 is a cross-sectional view taken along line 18-18 of FIG. 17.
Figure 19:
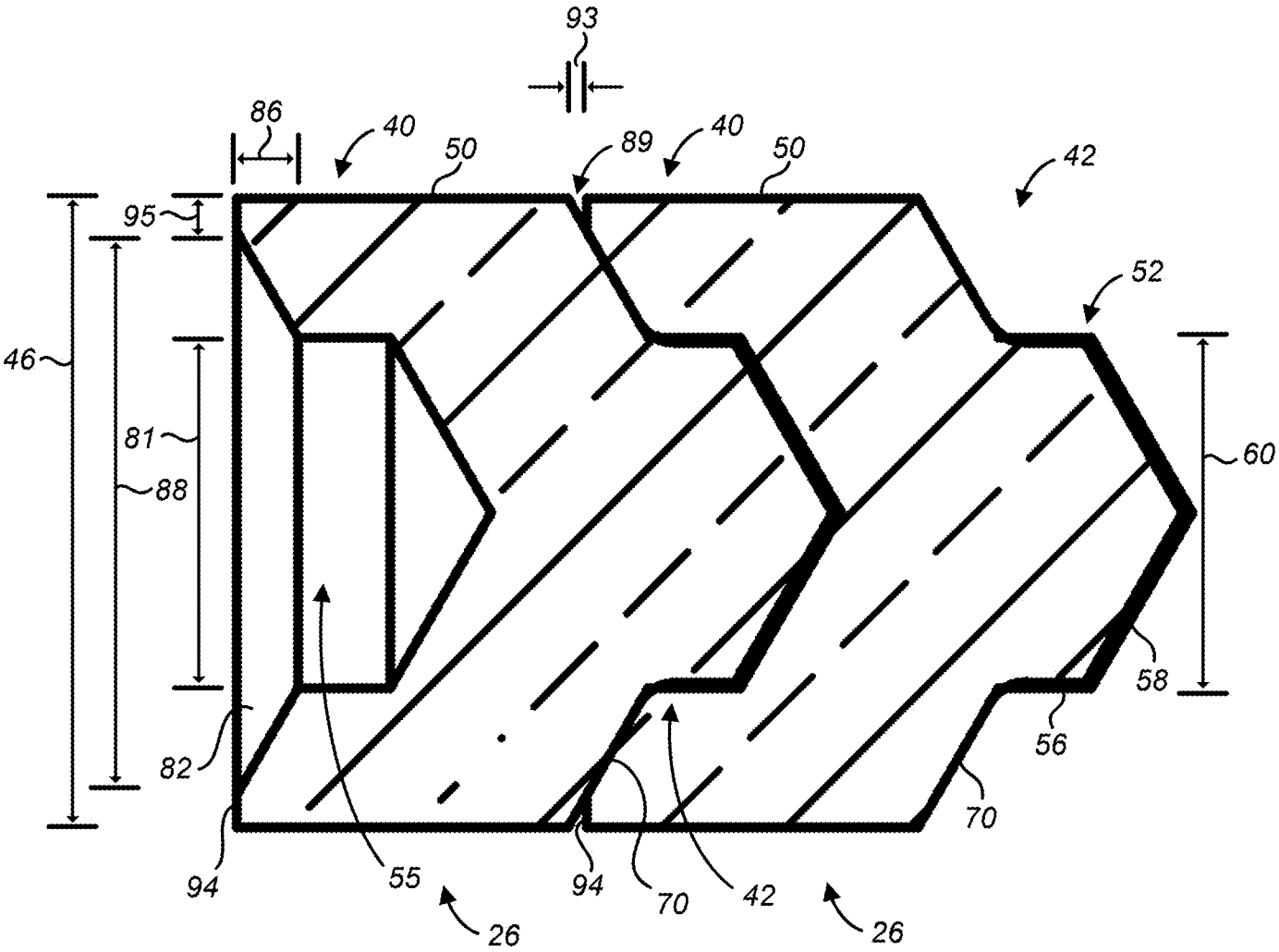
FIG. 19 is a further detailed cross-sectional view of two projectile segments of the apparatus of FIG. 4.

In at least one still further alternate embodiment, as best illustrated in FIGS. 17 and 18, the temporary engagement between the projectile nose 24 and the at least one projectile segment 26 of the projectile assembly 28 is achieved by the projectile nose 24 and the at least one projectile segment 26 being of unitary construction, with the projectile nose 24 and the at least one projectile segment 26 being longitudinally spaced apart from, and interconnected with, one another by an at least one connector portion 104 extending therebetween. In at least one embodiment, the at least one connector portion 104 is coaxially aligned with each of the projectile nose 24 and the at least one projectile segment 26. In at least one alternate embodiment, one or more of the at least one connector portion 104 may be non-coaxially aligned with the projectile nose 24 and the at least one projectile segment 26. In at least one such alternate embodiment, the projectile assembly 28 provides two or more radially arranged connector portions 104 extending between one or more of the projectile nose 24 and the at least one projectile segment 26. Additionally, in at least one embodiment, the at least one connector portion 104 is configured for breaking down or otherwise breaking apart from the percussive force of the projectile assembly 28 being fired from the firearm; thereby causing the projectile nose 24 and the at least one projectile segment 26 to separate from one another in flight. In at least one embodiment, the at least one connector portion 104 has a connector diameter 106 of approximately 0.010-0.125 inches. However, in at least one alternate embodiment, one or more of the at least one connector portion 104 may have a connector diameter 106 of less than 0.010 inches or greater than 0.125 inches, so long as the apparatus 20 is able to substantially carry out the functionality described herein. Additionally, in at least one embodiment, the at least one connector portion 104 has a connector length 108 of approximately 0.001-0.1 inches. However, in at least one alternate embodiment, one or more of the at least one connector portion 104 may have a connector length 108 of less than 0.001 inches or greater than 0.1 inches, so long as the apparatus 20 is able to substantially carry out the functionality described herein. By way of non-limiting example, the following table illustrates exemplary dimensions of the at least one connector portion 104 for select firearms of varying calibers. These exemplary dimensions are intended to be a mere subset of all possible dimensions for the at least one connector portion 104 and so should not be construed to limit any of the embodiments described herein.

Exemplary Connector Portion Dimensions

| Firearm Caliber | Connector Diameter (106) | Connector Length (108) |
|---|---|---|
| 9 × 19 mm | 0.125" | 1.000" |
| 556 × 45 mm | 0.100" | 1.500" |

-continued

| Exemplary Connector Portion Dimensions | | |
|---|---|---|
| Firearm Caliber | Connector Diameter (106) | Connector Length (108) |
| 6.8 × 51 mm | 0.125" | 2.000" |
| 7.62 × 39 mm | 0.125" | 2.000" |
| 7.62 × 51 mm | 0.125" | 2.000" |
| 12.7 × 99 mm | 0.125" | 4.500" |
| 20 × 102 mm | 0.250" | 7.500" |

In at least one embodiment, the at least one connector portion 104 (along with the projectile nose 24 and the at least one projectile segment 26 of the projectile assembly 28 in such embodiments) is constructed out of a relatively soft and/or brittle material that is capable of breaking down or otherwise breaking apart from the percussive force of the projectile assembly 28 being fired from the firearm, such as brass, copper, aluminum or steel, for example. However, in at least one alternate embodiment, the at least one connector portion 104 (along with the rest of the projectile assembly 28 in such embodiments) may be constructed out of any other material (or combination of materials) now known or later developed—dependent at least in part on the specific context in which the apparatus 20 is to be utilized, including but not limited to the specific type of firearm from which the apparatus 20 is to be fired—so long as the apparatus 20 is able to substantially carry out the functionality described herein. Similarly, in at least one alternate embodiment, the at least one connector shaft 98 may take on any other sizes, shapes, dimensions, configurations, quantities and/or arrangements, now known or later developed, so long as the apparatus 20 is able to substantially carry out the functionality described herein.

It should be noted that, in still further embodiments, the apparatus 20 may incorporate any combination of the above-discussed structures, techniques, materials and mechanisms for achieving the temporary engagement between the projectile nose 24 and the at least one projectile segment 26 of the projectile assembly 28. Furthermore, in at least one embodiment, the above-discussed structures, techniques, materials and mechanisms for achieving the temporary engagement between the projectile nose 24 and the at least one projectile segment 26 of the projectile assembly 28 are configured such that each of the projectile nose 24 and the at least one projectile segment 26 simultaneously separate from one another upon exiting the barrel of the firearm. In at least one alternate embodiment, the above-discussed structures, techniques, materials and mechanisms for achieving the temporary engagement between the projectile nose 24 and the at least one projectile segment 26 of the projectile assembly 28 may be configured such that one or more of the projectile nose 24 and the at least one projectile segment 26 separate from one another at varying times—for example, sequentially from the rearwardmost projectile segment 26 forward to the projectile nose 24—upon exiting the barrel of the firearm. Thus, in embodiments where the projectile nose 24 and the at least one projectile segment 26 separate from one another relatively early in flight after exiting the barrel of the firearm (and at a suitably far enough distance from the target), then asymmetric aerodynamic forces acting upon the projectile nose 24 and the at least one projectile segment 26 after separation can cause the projectile nose 24 and the at least one projectile segment 26 to scatter so that they impact the target in multiple locations. Alternatively, in embodiments where the projectile nose 24 and the at least one projectile segment 26 separate from one another relatively later in flight after exiting the barrel of the firearm (and at a suitably close enough distance to the target), then the projectile nose 24 and the at least one projectile segment 26 will be substantially axially aligned upon impacting the target, such that the projectile nose 24 and the at least one projectile segment 26 will sequentially impact the target in substantially the same location.

In at least one embodiment, the projectile nose 24 and the at least one projectile segment 26 of the projectile assembly 28 are constructed out of one or more of lead, brass, steel, iron, aluminum, copper, metal alloys, bismuth, zinc, depleted uranium, tungsten, tungsten carbide, wood, plastic, paper, porcelain, and composite materials. However, in at least one alternate embodiment, any other suitable material (or combination of materials), now known or later developed, may be substituted—dependent at least in part on the specific context in which the apparatus 20 is to be utilized, including but not limited to the specific type of firearm from which the apparatus 20 is to be fired—so long as the apparatus 20 is able to substantially carry out the functionality described herein. In at least one embodiment, each of the projectile nose 24 and the at least one projectile segment 26 are constructed out of the same material or combination of materials; however, in at least one alternate embodiment, one or more of the projectile nose 24 and the at least one projectile segment 26 are constructed out of a different material or combination of materials. In at least one embodiment, one or more of the projectile nose 24 and at least one projectile segment 26 is constructed so as to have an unbalanced weight (for example, one or more offset material bulges within said component, or internal pockets of materials within said component having different weights than the rest of said component) which, in turn, alters the flight path for such components after exiting the barrel of the firearm. In at least one embodiment, each of the projectile nose 24 and at least one projectile segment 26 have substantially the same weight. However, in at least one alternate embodiment, one or more of the projectile nose 24 and at least one projectile segment 26 has a different weight.

In at least one embodiment, as best illustrated in FIG. 2, the projectile casing 22 contains a volume of propellant material 110 positioned substantially between the rearwardmost projectile segment 26 and a casing primer 112 of the projectile casing 22. In at least one embodiment, the propellant material 110 (positioned behind the rearwardmost projectile segment 26) and the casing neck 30 (frictionally engaged with the projectile nose 24) cooperate to assist with maintaining the temporary engagement between the projectile nose 24 and the at least one projectile segment 26 of the projectile assembly 28. In at least one embodiment, the propellant material also circumferentially surrounds one or more of the projectile segments 26 so as to assist in maintaining axial alignment of the projectile segments 26. Additionally, in at least one embodiment, the type and amount of the propellant material 110 is capable of overcoming the temporary engagement between the projectile nose 24 and the at least one projectile segment 26 of the projectile assembly 28 when the projectile assembly 28 is fired from the firearm. Specifically, upon firing, the propellant material 110 is ignited by the casing primer 112 and subsequently deflagrates, with the resulting energy and pressure overcoming the fastening friction between the projectile nose 24 and the casing neck 30, in addition to overcoming the temporary engagement between the projectile nose 24 and the at least one projectile segment 26 at a predetermined time after launch of the projectile assembly 28, while the projectile nose 24 and at least one projectile segment 26 are simultaneously pushed through, and subsequently out, the barrel of the firearm. In at least one embodiment, the propellant material 110 is comprised of one or more of a black powder, a smokeless powder, and a bulk powder. However, in at least one alternate embodiment, any other suitable material (or combination of materials), now known or later developed, may be substituted—dependent at least in part on the specific context in which the apparatus 20 is to be utilized, including but not limited to the specific type of firearm from which the apparatus 20 is to be fired—so long as the apparatus 20 is able to substantially carry out the functionality described herein. Additionally, in at least one embodiment, the projectile casing 22 contains a compressed volume of the propellant material 110 equal to approximately 75% of the volume of the projectile casing 22. However, in further embodiments, the compressed volume of the propellant material 110 may be greater than 75% or less than 75% of the volume of the projectile casing 22. In other words, in at least one alternate embodiment, any other suitable amounts of propellant material 110, now known or later developed, may be substituted—dependent at least in part on type of propellant material 110 and the specific context in which the apparatus 20 is to be utilized, including but not limited to the specific type of firearm from which the apparatus 20 is to be fired—so long as the apparatus 20 is able to substantially carry out the functionality described herein.

Aspects of the present specification may also be described as the following embodiments:

1. A segmented projectile apparatus for a firearm, the apparatus comprising: a projectile casing; a projectile assembly frictionally positioned within the projectile casing, the projectile assembly comprising: a projectile nose and a plurality of projectile segments temporarily engageable with one another in axially aligned series; the projectile nose frictionally positioned within a casing neck of the projectile casing and having a nose leading end and an opposing nose trailing end; each of the projectile segments having a segment leading end and an opposing segment trailing end; the segment leading end of a forwardmost one of the projectile segments and the nose trailing end of the projectile nose having complementary surfaces, such that the segment leading end of the forwardmost one of the projectile segments is positionable in temporary abutting contact with the nose trailing end of the projectile nose; and the segment leading end of each of an at least one trailing one of the projectile segments and the segment trailing end of an immediately preceding one of the projectile segments having complementary surfaces, such that the segment leading end of each of the at least one trailing one of the projectile segments is positionable in temporary abutting contact with the segment trailing end of the immediately preceding one of the projectile segments; and a volume of compressed propellant material positioned substantially between a rearwardmost one of the projectile segments and a casing primer of the projectile casing, such that the propellant material and the casing neck of the projectile casing cooperate to assist with maintaining the temporary engagement between the projectile nose and the projectile segments; whereby, upon the projectile assembly being fired from the firearm via the projectile casing, the projectile nose and projectile segments separate from one another upon subsequently exiting a barrel of the firearm, thereby causing the projectile nose and projectile segments to radially separate from one another in flight toward an intended target.

2. The segmented projectile apparatus according to embodiment 1, wherein the projectile nose has a nose length of approximately 0.5-1.0 inches.

3. The segmented projectile apparatus according to embodiments 1-2, wherein the projectile nose has a nose length of less than 0.5 inches or greater than 1.0 inch.

4. The segmented projectile apparatus according to embodiments 1-3, wherein the nose trailing end has a nose trailing diameter of approximately 0.2-0.4 inches.

5. The segmented projectile apparatus according to embodiments 1-4, wherein the nose trailing end has a nose trailing diameter of less than 0.2 inches or greater than 0.4 inches.

6. The segmented projectile apparatus according to embodiments 1-5, wherein the nose leading end of the projectile nose is substantially ogive-shaped.

7. The segmented projectile apparatus according to embodiments 1-6, wherein the nose trailing end of the projectile nose is substantially cylindrical-shaped.

8. The segmented projectile apparatus according to embodiments 1-7, wherein the segment trailing end of each of the projectile segments is substantially cylindrical-shaped.

9. The segmented projectile apparatus according to embodiments 1-8, wherein each of the projectile segments has a segment length that is less than the nose length of the projectile nose.

10. The segmented projectile apparatus according to embodiments 1-9, wherein one or more of the projectile segments has a segment length that is equal to or greater than a nose length of the projectile nose.

11. The segmented projectile apparatus according to embodiments 1-10, wherein each of the projectile segments has a segment length of approximately 0.1-0.5 inches.

12. The segmented projectile apparatus according to embodiments 1-11, wherein one or more of the projectile segments has a segment length of less than 0.1 inches or greater than 0.5 inches.

13. The segmented projectile apparatus according to embodiments 1-12, wherein each of the projectile segments has a segment trailing diameter of approximately 0.2-0.4 inches.

14. The segmented projectile apparatus according to embodiments 1-13, wherein one or more of the projectile segments has a segment trailing diameter of less than 0.2 inches or greater than 0.4 inches.

15. The segmented projectile apparatus according to embodiments 1-14, wherein the segment trailing diameter of each of the projectile segments is substantially the same as the nose trailing diameter of the projectile nose, such that the projectile assembly has a substantially uniform outer diameter.

16. The segmented projectile apparatus according to embodiments 1-15, wherein the segment trailing diameter of one or more of the projectile segments is different than the nose trailing diameter of the projectile nose.

17. The segmented projectile apparatus according to embodiments 1-16, wherein the segment trailing end of each of the projectile segments has a substantially uniform segment trailing sidewall.

18. The segmented projectile apparatus according to embodiments 1-17, wherein the segment trailing end of one or more of the projectile segments has a non-uniform segment trailing sidewall.

19. The segmented projectile apparatus according to embodiments 1-18, wherein: the segment leading end of each of the segment projectiles provides an engagement protrusion; the engagement protrusion of the forwardmost one of the projectile segments configured for being removably engaged with a corresponding rearwardly opening nose engagement cavity provided by the nose trailing end of the projectile nose, so as to create a temporary frictional, press-fit engagement therebetween; and the engagement protrusion of each of the at least one trailing one of the projectile segments configured for being removably engaged with a corresponding rearwardly opening segment engagement cavity provided by the segment trailing end of the immediately preceding one of the projectile segments, so as to create a temporary frictional, press-fit engagement therebetween.

20. The segmented projectile apparatus according to embodiments 1-19, wherein: the nose engagement cavity of the projectile nose is coaxial with a longitudinal axis of the projectile nose; the segment engagement cavity of each of the projectile segments is coaxial with a longitudinal axis of said projectile segment; and the engagement protrusion of each of the projectile segments is coaxial with the longitudinal axis of said projectile segment.

21. The segmented projectile apparatus according to embodiments 1-20, wherein the engagement protrusion of each of the projectile segments provides a protrusion base on which is positioned a protrusion tip.

22. The segmented projectile apparatus according to embodiments 1-21, wherein the protrusion base is substantially cylindrical in shape.

23. The segmented projectile apparatus according to embodiments 1-22, wherein the protrusion base of each of the projectile segments has a base diameter of approximately 0.1-0.2 inches.

24. The segmented projectile apparatus according to embodiments 1-23, wherein the protrusion base of one or more of the projectile segments has a base diameter of less than 0.1 inches or greater than 0.2 inches.

25. The segmented projectile apparatus according to embodiments 1-24, wherein the protrusion base of each of the projectile segments has a base length of approximately 0.01-0.1 inches.

26. The segmented projectile apparatus according to embodiments 1-25, wherein the protrusion base of one or more of the projectile segments has a base length of less than 0.01 inches or greater than 0.1 inches.

27. The segmented projectile apparatus according to embodiments 1-26, wherein the protrusion tip of each of the projectile segments has a tapered, substantially conical shape.

28. The segmented projectile apparatus according to embodiments 1-27, wherein the protrusion tip of each of the projectile segments has a tip angle of approximately 60 degrees relative to the protrusion base.

29. The segmented projectile apparatus according to embodiments 1-28, wherein the protrusion tip of one or more of the projectile segments has a tip angle of less than 60 degrees or greater than 60 degrees relative to the protrusion base.

30. The segmented projectile apparatus according to embodiments 1-29, wherein the protrusion tip of each of the projectile segments has a tip diameter of approximately 0.1-0.2 inches.

31. The segmented projectile apparatus according to embodiments 1-30, wherein the protrusion tip of one or more of the projectile segments has a tip diameter of less than 0.1 inches or greater than 0.2 inches.

32. The segmented projectile apparatus according to embodiments 1-31, wherein the protrusion tip of each of the projectile segments has a tip length of approximately 0.01-0.1 inches.

33. The segmented projectile apparatus according to embodiments 1-32, wherein the protrusion tip of one or more of the projectile segments has a tip length of less than 0.01 inches or greater than 0.1 inches.

34. The segmented projectile apparatus according to embodiments 1-33, wherein the engagement protrusion of each of the projectile segments further provides a tapered protrusion shoulder positioned and configured for creating a transition surface between the protrusion base and a segment trailing sidewall of the segment trailing end of said projectile segment.

35. The segmented projectile apparatus according to embodiments 1-34, wherein the protrusion shoulder of each of the projectile segments has a shoulder angle of approximately 60 degrees relative to the segment trailing end.

36. The segmented projectile apparatus according to embodiments 1-35, wherein the protrusion shoulder of one or more of the projectile segments has a shoulder angle of less than 60 degrees or greater than 60 degrees relative to the segment trailing end.

37. The segmented projectile apparatus according to embodiments 1-36, wherein the protrusion shoulder of each of the projectile segments has a shoulder diameter of approximately 0.1-0.2 inches.

38. The segmented projectile apparatus according to embodiments 1-37, wherein the protrusion shoulder of one or more of the projectile segments has a shoulder diameter of less than 0.1 inches or greater than 0.2 inches.

39. The segmented projectile apparatus according to embodiments 1-38, wherein the protrusion shoulder of each of the projectile segments has a shoulder length of approximately 0.01-0.1 inches.

40. The segmented projectile apparatus according to embodiments 1-39, wherein the protrusion shoulder of one or more of the projectile segments has a shoulder length of less than 0.01 inches or greater than 0.1 inches.

41. The segmented projectile apparatus according to embodiments 1-40, wherein the segment trailing end of each of the projectile segments has a trailing end length of approximately 0.1-0.3 inches.

42. The segmented projectile apparatus according to embodiments 1-41, wherein the segment trailing end of one or more of the projectile segments has a trailing end length of less than 0.1 inches or greater than 0.3 inches.

43. The segmented projectile apparatus according to embodiments 1-42, wherein the segment leading end of each of the projectile segments has a leading end length of approximately 0.03-0.3 inches.

44. The segmented projectile apparatus according to embodiments 1-43, wherein the segment leading end of one or more of the projectile segments has a leading end length of less than 0.03 inches or greater than 0.3 inches.

45. The segmented projectile apparatus according to embodiments 1-44, wherein the nose engagement cavity of the projectile nose is relatively larger than the engagement protrusion of the forwardmost one of the projectile segments, so as to form an at least one pocket of space therebetween when the engagement protrusion of the forwardmost one of the projectile segments is removably engaged with the nose engagement cavity.

46. The segmented projectile apparatus according to embodiments 1-45, wherein the segment engagement cavity of one or more of the at least one trailing one of the projectile segments is relatively larger than the engagement protrusion of an immediately succeeding trailing one of the projectile segments, so as to form an at least one pocket of space therebetween when the engagement protrusion of the immediately succeeding one of the projectile segments is removably engaged with the segment engagement cavity of said at least one trailing one of the projectile segments.

47. The segmented projectile apparatus according to embodiments 1-46, wherein a circumferential edge of the nose engagement cavity of the projectile nose provides a circumferential cavity chamfer configured for preventing the projectile nose and the forwardmost one of the projectile segments from fusing together upon the projectile assembly being fired from the firearm.

48. The segmented projectile apparatus according to embodiments 1-47, wherein the cavity chamfer of the nose engagement cavity is configured for closely approximating the size, shape and dimensions of the protrusion shoulder of the forwardmost one of the projectile segments.

49. The segmented projectile apparatus according to embodiments 1-48, wherein the cavity chamfer of the nose engagement cavity has a chamfer angle of approximately 60 degrees relative to the nose trailing end.

50. The segmented projectile apparatus according to embodiments 1-49, wherein the cavity chamfer of the nose engagement cavity has a chamfer angle of less than 60 degrees or greater than 60 degrees relative to the nose trailing end.

51. The segmented projectile apparatus according to embodiments 1-50, wherein the cavity chamfer of the nose engagement cavity has a chamfer length of approximately 0.01-0.1 inches.

52. The segmented projectile apparatus according to embodiments 1-51, wherein the cavity chamfer of the nose engagement cavity has a chamfer length of less than 0.01 inches or greater than 0.1 inches.

53. The segmented projectile apparatus according to embodiments 1-52, wherein: the cavity chamfer of the projectile nose has a chamfer diameter that is relatively smaller than the nose trailing diameter of the projectile nose, such that the nose trailing end provides a nose trailing perimeter face between the cavity chamfer and a nose trailing sidewall of the nose trailing end; the nose trailing perimeter face is oriented substantially normal to the nose trailing sidewall; and the chamfer diameter of the cavity chamfer of the projectile nose is also relatively smaller than the shoulder diameter of the protrusion shoulder of the forwardmost one of the projectile segments, thereby creating a circumferential engagement gap between the nose trailing perimeter face and the protrusion shoulder of forwardmost one of the projectile segments.

54. The segmented projectile apparatus according to embodiments 1-53, wherein the nose trailing perimeter face has a nose trailing perimeter face width of approximately 0.01-0.05 inches.

55. The segmented projectile apparatus according to embodiments 1-54, wherein the nose trailing perimeter face has a nose trailing perimeter face width of less than 0.01 inches or greater than 0.05 inches.

56. The segmented projectile apparatus according to embodiments 1-55, wherein a circumferential edge of the segment engagement cavity of each of the at least one trailing one of the projectile segments provides a circumferential cavity chamfer configured for preventing said at least one trailing one of the projectile segments and an immediately succeeding trailing one of the projectile segments from fusing together upon the projectile assembly being fired from the firearm.

57. The segmented projectile apparatus according to embodiments 1-56, wherein the cavity chamfer of the segment engagement cavity of the at least one trailing one of the projectile segments is configured for closely approximating the size, shape and dimensions of the protrusion shoulder of the immediately succeeding trailing one of the projectile segments.

58. The segmented projectile apparatus according to embodiments 1-57, wherein the cavity chamfer of the segment engagement cavity of the at least one trailing one of the projectile segments has a chamfer angle of approximately 60 degrees relative to the segment trailing end of said projectile segment.

59. The segmented projectile apparatus according to embodiments 1-58, wherein the cavity chamfer of the segment engagement cavity of the at least one trailing one of the projectile segments has a chamfer angle of less than 60 degrees or greater than 60 degrees relative to the segment trailing end of said projectile segment.

60. The segmented projectile apparatus according to embodiments 1-59, wherein the cavity chamfer of the segment engagement cavity of the at least one trailing one of the projectile segments has a chamfer length of approximately 0.01-0.1 inches.

61. The segmented projectile apparatus according to embodiments 1-60, wherein the cavity chamfer of the segment engagement cavity of the at least one trailing one of the projectile segments has a chamfer length of less than 0.01 inches or greater than 0.1 inches.

62. The segmented projectile apparatus according to embodiments 1-61, wherein: the cavity chamfer of the segment engagement cavity of the at least one trailing one of the projectile segments has a chamfer diameter that is relatively smaller than the segment trailing diameter of said projectile segment, such that the segment trailing end provides a segment trailing perimeter face between the cavity chamfer and a segment trailing sidewall of the segment trailing end; the segment trailing perimeter face is oriented substantially normal to the segment trailing sidewall; and the chamfer diameter of said projectile segment is also relatively smaller than the shoulder diameter of the protrusion shoulder of an immediately succeeding trailing one of the projectile segments, thereby creating a circumferential engagement gap between said projectile segments.

63. The segmented projectile apparatus according to embodiments 1-62, wherein the segment trailing perimeter face has a segment trailing perimeter face width of approximately 0.01-0.05 inches.

64. The segmented projectile apparatus according to embodiments 1-63, wherein the segment trailing perimeter face has a segment trailing perimeter face width of less than 0.01 inches or greater than 0.05 inches.

65. The segmented projectile apparatus according to embodiments 1-64, wherein the projectile assembly further comprises: a temporary adhesive material positioned between the segment leading end of the forwardmost one of the projectile segments and the nose trailing end of the projectile nose; and the temporary adhesive material further positioned between the segment leading end of each of the at least one trailing one of the projectile segments and the segment trailing end of the immediately preceding one of the projectile segments; wherein, the temporary adhesive material is configured for breaking down or otherwise breaking apart from a percussive force of the projectile assembly being fired from the firearm.

66. The segmented projectile apparatus according to embodiments 1-65, wherein the temporary adhesive comprises at least one of epoxy, cyanoacrylates, polyurethanes, or acrylics.

67. The segmented projectile apparatus according to embodiments 1-66, wherein the projectile assembly further comprises: a projectile sabot sized and configured for tightly conforming to and temporarily encompassing the projectile nose and projectile segments, so as to temporarily retain the projectile nose and projectile segments in substantially axially aligned abutting contact; wherein, the temporary projectile sabot is configured for breaking down or otherwise breaking apart from a percussive force of the projectile assembly being fired from the firearm.

68. The segmented projectile apparatus according to embodiments 1-67, wherein the projectile sabot is constructed out of at least one of brass, copper or aluminum, polycarbonates, polypropylene, polyethylene, acrylonitrile butadiene styrene, nylon, acetal and acrylics.

69. The segmented projectile apparatus according to embodiments 1-68, wherein the projectile assembly further comprises: an at least one elongate connector shaft extending through a corresponding connector passage of each of the projectile nose and projectile segments, the at least one connector shaft having a shaft diameter that closely approximates an inner diameter of each of the nose engagement cavity of the nose trailing end of the projectile nose and the connector passage of each of the projectile segments, so as to create a frictional engagement therebetween; wherein, the at least one connector shaft is configured for breaking down or otherwise breaking apart from a percussive force of the projectile assembly being fired from the firearm.

70. The segmented projectile apparatus according to embodiments 1-69, wherein the at least one connector shaft extends coaxially through each of the projectile nose and projectile segments.

71. The segmented projectile apparatus according to embodiments 1-70, wherein one or more of the at least one connector shaft extends non-coaxially through each of the projectile nose and projectile segments.

72. The segmented projectile apparatus according to embodiments 1-71, wherein the at least one connector shaft has a shaft diameter of approximately 0.010-0.125 inches.

73. The segmented projectile apparatus according to embodiments 1-72, wherein one or more of the at least one connector shaft has have a shaft diameter of less than 0.010 inches or greater than 0.125 inches.

74. The segmented projectile apparatus according to embodiments 1-73, wherein the at least one connector shaft is constructed out of at least one of brass, copper or aluminum, polycarbonates, polypropylene, polyethylene, acrylonitrile butadiene styrene, nylon, acetal and acrylics.

75. The segmented projectile apparatus according to embodiments 1-74, wherein: the projectile nose and projectile segments are of unitary construction, with the projectile nose and projectile segments being longitudinally spaced apart from, and interconnected with, one another by an at least one connector portion extending therebetween; wherein, the at least one connector portion is configured for breaking down or otherwise breaking apart from a percussive force of the projectile assembly being fired from the firearm.

76. The segmented projectile apparatus according to embodiments 1-75, wherein the at least one connector portion is coaxially aligned with each of the projectile nose and projectile segments.

77. The segmented projectile apparatus according to embodiments 1-76, wherein one or more of the at least one connector portion are not coaxially aligned with each of the projectile nose and projectile segments.

78. The segmented projectile apparatus according to embodiments 1-77, wherein the at least one connector portion has a connector diameter of approximately 0.010-0.125 inches.

79. The segmented projectile apparatus according to embodiments 1-78, wherein one or more of the at least one connector portion has a connector diameter of less than 0.010 inches or greater than 0.125 inches.

80. The segmented projectile apparatus according to embodiments 1-79, wherein the at least one connector portion has a connector length of approximately 0.001-0.1 inches.

81. The segmented projectile apparatus according to embodiments 1-80, wherein one or more of the at least one connector portion has a connector length of less than 0.001 inches or greater than 0.1 inches.

82. The segmented projectile apparatus according to embodiments 1-81, wherein the projectile nose and the projectile segments are constructed out of one or more of lead, brass, steel, iron, aluminum, copper, metal alloys, bismuth, zinc, depleted uranium, tungsten, tungsten carbide, wood, plastic, paper, porcelain, and composite materials.

83. The segmented projectile apparatus according to embodiments 1-82, wherein the volume of compressed propellant material is capable of overcoming the temporary engagement between the projectile nose and the projectile segments when the projectile assembly is fired from the firearm.

84. The segmented projectile apparatus according to embodiments 1-83, wherein the propellant material is comprised of one or more of a black powder, a smokeless powder, and a bulk powder.

85. The segmented projectile apparatus according to embodiments 1-84, wherein the compressed volume of the propellant material is equal to approximately 75% of a volume of the projectile casing.

86. The segmented projectile apparatus according to embodiments 1-85, wherein the compressed volume of the propellant material is equal to less than 75% or greater than 75% of a volume of the projectile casing.

87. The segmented projectile apparatus according to embodiments 1-86, wherein the nose engagement cavity of the projectile nose has a cavity diameter of approximately 0.1-0.2 inches.

88. The segmented projectile apparatus according to embodiments 1-87, wherein the nose engagement cavity of the projectile nose has a cavity diameter of less than 0.1 inches or greater than 0.2 inches.

89. The segmented projectile apparatus according to embodiments 1-88, wherein the segment engagement cavity of one or more of the projectile segments has a cavity diameter of approximately 0.1-0.2 inches.

90. The segmented projectile apparatus according to embodiments 1-89, wherein the segment engagement cavity of one or more of the projectile segments has a cavity diameter of less than 0.1 inches or greater than 0.2 inches.

91. The segmented projectile apparatus according to embodiments 1-90, wherein: the nose engagement cavity has a cavity diameter that is approximately 0.002 inches larger than a base diameter of the protrusion base of the forwardmost one of the projectile segments; and the segment engagement cavity of each of the projectile segments has a cavity diameter that is approximately 0.002 inches larger than a base diameter of the engagement protrusion of the corresponding at least one trailing one of the projectile segments.

92. The segmented projectile apparatus according to embodiments 1-91, wherein the engagement gap between the nose trailing perimeter face and the protrusion shoulder of the forwardmost projectile segment has a gap distance of approximately 0.010-0.050 inches.

93. The segmented projectile apparatus according to embodiments 1-92, wherein the engagement gap between the nose trailing perimeter face and the protrusion shoulder of the forwardmost projectile segment has a gap distance of less than 0.010 inches or greater than 0.050 inches.

94. The segmented projectile apparatus according to embodiments 1-93, wherein the engagement gap between the segment trailing perimeter face and the protrusion shoulder of the subsequent trailing projectile segment has a gap distance of approximately 0.010-0.050 inches.

95. The segmented projectile apparatus according to embodiments 1-94, wherein the engagement gap between the segment trailing perimeter face and the protrusion shoulder of the subsequent trailing projectile segment has a gap distance of less than 0.010 inches or greater than 0.050 inches.

96. A segmented projectile apparatus for a firearm, the apparatus comprising: a projectile casing; a projectile assembly frictionally positioned within the projectile casing, the projectile assembly comprising: a projectile nose and a plurality of projectile segments temporarily engageable with one another in axially aligned series; the projectile nose frictionally positioned within a casing neck of the projectile casing and having a substantially ogive-shaped nose leading end and an opposing nose trailing end; each of the projectile segments having a segment leading end and an opposing segment trailing end; the segment leading end of each of the segment projectiles providing an engagement protrusion substantially coaxially aligned with a longitudinal axis of said projectile segment; the engagement protrusion of a forwardmost one of the projectile segments configured for being removably engaged with a corresponding rearwardly opening nose engagement cavity provided by the nose trailing end of the projectile nose, so as to create a temporary frictional, press-fit engagement therebetween, the nose engagement cavity substantially coaxially aligned with a longitudinal axis of the projectile nose; and the engagement protrusion of each of an at least one trailing one of the projectile segments configured for being removably engaged with a corresponding rearwardly opening segment engagement cavity provided by the segment trailing end of an immediately preceding one of the projectile segments, so as to create a temporary frictional, press-fit engagement therebetween, each segment engagement cavity substantially coaxially aligned with the longitudinal axis of the corresponding projectile segment; and a volume of compressed propellant material positioned substantially between a rearwardmost one of the projectile segments and a casing primer of the projectile casing, such that the propellant material and the casing neck of the projectile casing cooperate to assist with maintaining the temporary engagement between the projectile nose and the projectile segments; whereby, upon the projectile assembly being fired from the firearm via the projectile casing, the projectile nose and projectile segments separate from one another upon subsequently exiting a barrel of the firearm, thereby causing the projectile nose and projectile segments to radially separate from one another in flight toward an intended target.

97. A segmented projectile apparatus for a firearm, the apparatus comprising: a projectile casing; a projectile assembly frictionally positioned within the projectile casing, the projectile assembly comprising: a projectile nose and a plurality of projectile segments temporarily engageable with one another in axially aligned series; the projectile nose frictionally positioned within a casing neck of the projectile casing and having a substantially ogive-shaped nose leading end and an opposing nose trailing end; each of the projectile segments having a segment leading end and an opposing segment trailing end; the segment leading end of each of the segment projectiles providing an engagement protrusion substantially coaxially aligned with a longitudinal axis of said projectile segment; the engagement protrusion of a forwardmost one of the projectile segments configured for being removably engaged with a corresponding rearwardly opening nose engagement cavity provided by the nose trailing end of the projectile nose, so as to create a temporary frictional, press-fit engagement therebetween, the nose engagement cavity substantially coaxially aligned with a longitudinal axis of the projectile nose; a circumferential edge of the nose engagement cavity providing a circumferential cavity chamfer configured for preventing the projectile nose and the forwardmost one of the projectile segments from fusing together upon the projectile assembly being fired from the firearm; the engagement protrusion of each of an at least one trailing one of the projectile segments configured for being removably engaged with a corresponding rearwardly opening segment engagement cavity provided by the segment trailing end of an immediately preceding one of the projectile segments, so as to create a temporary frictional, press-fit engagement therebetween, each segment engagement cavity substantially coaxially aligned with the longitudinal axis of the corresponding projectile segment; and a circumferential edge of the segment engagement cavity of each of the at least one trailing one of the projectile segments providing a circumferential cavity chamfer configured for preventing said at least one trailing one of the projectile segments and an immediately succeeding trailing one of the projectile segments from fusing together upon the projectile assembly being fired from the firearm; and a volume of compressed propellant material positioned substantially between a rearwardmost one of the projectile segments and a casing primer of the projectile casing, such that the propellant material and the casing neck of the projectile casing cooperate to assist with maintaining the temporary engagement between the projectile nose and the projectile segments; whereby, upon the projectile assembly being fired from the firearm via the projectile casing, the projectile nose and projectile segments separate from one another upon subsequently exiting a barrel of the firearm, thereby causing the projectile nose and projectile segments to radially separate from one another in flight toward an intended target.

98. A segmented projectile apparatus for a firearm, the apparatus comprising: a projectile casing; and a projectile assembly frictionally positioned within the projectile casing, the projectile assembly comprising: a plurality of projectile segments temporarily engageable with one another in axially aligned series, each projectile segment having a segment leading end and an opposing segment trailing end; and the segment leading end of each of the projectile segments and the segment trailing end of an immediately preceding one of the projectile segments having complementary surfaces, such that the segment leading end of each of the projectile segments is temporarily frictionally engaged with the segment trailing end of the immediately preceding one of the projectile segments; whereby, upon the projectile assembly being fired from the firearm via the projectile casing, the projectile segments separate from one another upon subsequently exiting a barrel of the firearm, thereby causing the projectile segments to radially separate from one another in flight toward an intended target.

99. A segmented projectile apparatus for a firearm, the apparatus comprising: a projectile casing; and a projectile assembly frictionally positioned within the projectile casing, the projectile assembly comprising: a plurality of projectile segments temporarily engageable with one another in axially aligned series, each projectile segment having a segment leading end and an opposing segment trailing end; and the segment leading end of each of the projectile segments and the segment trailing end of an immediately preceding one of the projectile segments having complementary surfaces, such that the segment leading end of each of the projectile segments is temporarily frictionally engaged with the segment trailing end of the immediately preceding one of the projectile segments; whereby, upon the projectile assembly being fired from the firearm via the projectile casing, the projectile segments separate from one another upon subsequently exiting a barrel of the firearm, thereby causing the projectile segments to radially separate from one another in flight toward an intended target.

100. The segmented projectile apparatus of embodiment 99 wherein the plurality of projectile segments are joined using a press fit engagement such that an engagement protrusion in the segment leading end of each of the projectile segments is frictionally engaged with an engagement cavity in the trailing end of the immediately preceding one of the projectile segments.

101. The segmented projectile apparatus of embodiment 100 wherein a cavity diameter of the engagement cavity is between 0.01 and 0.0002 inches in difference from a base diameter of the corresponding engagement protrusion.

102. The segmented projectile apparatus of embodiment 100-101 wherein the cavity diameter of the engagement cavity is approximately 0.002 inches in difference from a base diameter of the corresponding engagement protrusion.

103. The segmented projectile apparatus of any of embodiments 100-102 wherein the engagement protrusion incorporates an engagement lip of a larger diameter than the base diameter for engagement with a counterpart circumferential engagement lip of a corresponding difference in diameter within the engagement cavity.

104. The segmented projectile apparatus of embodiment 99 further comprising a temporary adhesive that maintains the plurality of projectile segments in engagement with one another until the segmented projectile apparatus is fired.

105. The segmented projectile apparatus of either of embodiments 99 and 104 further comprising a projectile sabot for maintaining the plurality of projectile segments in engagement with one another until the segmented projectile apparatus is fired.

106. The segmented projectile apparatus of any of embodiments 99-105 wherein a segment trailing end of at least one of the plurality of projectile segments has a non-uniform segment trailing sidewall.

107. The segmented projectile apparatus of embodiment 99 further comprising a connector passage through each of the plurality of projectile segments, thereby defining a coaxial chamber within each of the plurality of projectile segments; and a connector shaft placed within the connector passage, thereby temporarily frictionally engaging each of the plurality of projectile segments until the segmented projectile apparatus is fired.

108. The segmented projectile apparatus of embodiment 107 wherein the connector shaft has a shaft diameter of approximately 0.010-0.125 inches.

109. The segmented projectile apparatus of embodiments 107-108, wherein the connector shaft is constructed out of at least one of brass, copper or aluminum, polycarbonates, polypropylene, polyethylene, acrylonitrile butadiene styrene, nylon, acetal and acrylics.

110. The segmented projectile apparatus of embodiment 99 further comprising a connector portion joining each of the plurality of projectile segments.

111. The segmented projectile apparatus of embodiment 110 wherein the connector portion has a shaft diameter of approximately 0.010-0.125 inches.

112. The segmented projectile apparatus of embodiments 110-111, wherein the connector portion is constructed out of at least one of brass, copper or aluminum, polycarbonates, polypropylene, polyethylene, acrylonitrile butadiene styrene, nylon, acetal and acrylics.

113. The segmented projectile apparatus of any of embodiments 99-112 further comprising a projectile nose, frictionally engaged forwardmost of the plurality of projectile segments.

114. The segmented projectile apparatus of any of embodiments 99-113 further comprising a projectile casing, in which at least the plurality of projectile segments are encased until the segmented projectile apparatus is fired.

115. The segmented projectile apparatus of embodiment 100-103 wherein the engagement cavity has a diameter of 0.200 inches in a selected one of a 9×19 millimeter round, a 6.8×51 millimeter round, and a 7.62×51 millimeter round.

116. The segmented projectile apparatus of embodiment 100-103 wherein the engagement cavity has a diameter of 0.400 inches in a 12.7 millimeter round.

117. The segmented projectile apparatus of embodiment 100-103 wherein the engagement cavity has a diameter of 0.625 inches in a 20 millimeter round.

118. The segmented projectile apparatus of embodiment 100-103 wherein the engagement cavity has a diameter of 0.125 inches in a 5.56×45 millimeter round.

In closing, regarding the exemplary embodiments shown and described herein, it will be appreciated that a segmented projectile apparatus for firearms is disclosed and capable of being loaded into and fired from any traditional, pre-existing firearm while also being configured for creating a shotgun-like spread. Because the principles of this disclosure may be practiced in a number of configurations beyond those shown and described, it is to be understood that the disclosure is not in any way limited by the exemplary embodiments, but is generally directed to a segmented projectile apparatus and is able to take numerous forms to do so without departing from the spirit and scope of this disclosure. It will also be appreciated by those skilled in the art that the disclosure is not limited to the particular geometries and materials of construction disclosed, but may instead entail other functionally comparable structures or materials, now known or later developed, without departing from the overall spirit and scope of the disclosure.

Certain embodiments are described herein, including the best mode known to the inventor(s) for carrying out the segmented projectile apparatus. Of course, variations on these described embodiments will become apparent to those of ordinary skill in the art upon reading the foregoing description. The inventor(s) expect skilled artisans to employ such variations as appropriate, and the inventor(s) intend for the segmented projectile apparatus to be practiced otherwise than specifically described herein. Accordingly, this disclosure includes all modifications and equivalents of the subject matter recited in the claims appended hereto as permitted by applicable law. Moreover, any combination of the above-described embodiments in all possible variations thereof is encompassed by the disclosure unless otherwise indicated herein or otherwise clearly contradicted by context.

Groupings of alternative embodiments, elements, or steps of the present disclosure are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the terms "about" and "approximately." As used herein, the terms "about" and "approximately" mean that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques.

Notwithstanding that the numerical ranges and values setting forth the broad scope of the disclosure are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein. Similarly, as used herein, unless indicated to the contrary, the term "substantially" is a term of degree intended to indicate an approximation of the characteristic, item, quantity, parameter, property, or term so qualified, encompassing a range that can be understood and construed by those of ordinary skill in the art, or at least encompassing a range of plus or minus ten percent above and below the value of the stated characteristic, item, quantity, parameter, property, or term.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of the present disclosure (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or exemplary language (e.g., "such as") provided herein is intended merely to better illuminate the present disclosure and does not pose a limitation on the scope of the disclosure otherwise claimed. No language in the present specification should be construed as indicating any non-claimed element essential to the practice of the concepts disclosed herein.

When used in the claims, whether as filed or added per amendment, the open-ended transitional term "comprising" (along with equivalent open-ended transitional phrases thereof such as "including," "containing" and "having") encompasses all the expressly recited elements, limitations, steps and/or features alone or in combination with un-recited subject matter; the named elements, limitations and/or features are essential, but other unnamed elements, limitations and/or features may be added and still form a construct within the scope of the claim. Specific embodiments disclosed herein may be further limited in the claims using the closed-ended transitional phrases "consisting of" or "consisting essentially of" in lieu of or as an amendment for "comprising." When used in the claims, whether as filed or added per amendment, the closed-ended transitional phrase "consisting of" excludes any element, limitation, step, or feature not expressly recited in the claims. The closed-ended transitional phrase "consisting essentially of" limits the scope of a claim to the expressly recited elements, limitations, steps and/or features and any other elements, limitations, steps and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps and/or features specifically recited in the claim, whereas the meaning of the closed-ended transitional phrase "consisting essentially of" is being defined as only including those elements, limitations, steps and/or features specifically recited in the claim and those elements, limitations, steps and/or features that do not materially affect the basic and novel characteristic(s) of the claimed subject matter.

Therefore, the open-ended transitional phrase "comprising" (along with equivalent open-ended transitional phrases thereof) includes within its meaning, as a limiting case, claimed subject matter specified by the closed-ended transitional phrases "consisting of" or "consisting essentially of." As such, embodiments described herein or so claimed with the phrase "comprising" are expressly or inherently unambiguously described, enabled and supported herein for the phrases "consisting essentially of" and "consisting of."

Any claims intended to be treated under 35 U.S.C. § 112(f) will begin with the words "means for," but use of the term "for" in any other context is not intended to invoke treatment under 35 U.S.C. § 112(f). Accordingly, Applicant reserves the right to pursue additional claims after filing this application, in either this application or in a continuing application.

It should be understood that any methods disclosed herein, along with the order in which the respective elements of any such method are performed, are purely exemplary. Depending on the implementation, they may be performed in any order or in parallel, unless indicated otherwise in the present disclosure.

All patents, patent publications, and other publications referenced and identified in the present specification are individually and expressly incorporated herein by reference in their entirety for the purpose of describing and disclosing, for example, the compositions and methodologies described in such publications that might be used in connection with the present disclosure. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents are based on the information available to the applicant and does not constitute any admission as to the correctness of the dates or contents of these documents.

While aspects of the disclosure have been described with reference to at least one exemplary embodiment, it is to be clearly understood by those skilled in the art that the disclosure is not limited thereto. Rather, the scope of the disclosure is to be interpreted only in conjunction with the appended claims.

All of the material in this patent document issue subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

What is claimed is:

1. A segmented projectile apparatus for a firearm, the apparatus comprising:

a projectile casing;

a projectile assembly frictionally positioned within the projectile casing, the projectile assembly comprising:

a projectile nose and a plurality of projectile segments temporarily engageable with one another in axially aligned series;

the projectile nose frictionally positioned within a casing neck of the projectile casing and having a nose leading end and an opposing nose trailing end;

each of the projectile segments having a segment leading end and an opposing segment trailing end;

the segment leading end of each of the segment projectiles providing an engagement protrusion which provides a protrusion base on which is positioned a protrusion tip;

the engagement protrusion of a forwardmost one of the projectile segments configured for being removably engaged with a corresponding rearwardly opening nose engagement cavity provided by the nose trailing end of the projectile nose, so as to create a temporary frictional, press-fit engagement therebetween; and the engagement protrusion of each of an at least one trailing one of the projectile segments configured for being removably engaged with a corresponding rearwardly opening segment engagement cavity provided by the segment trailing end of an immediately preceding one of the projectile segments, so as to create a temporary frictional, press-fit engagement therebetween;

and a volume of compressed propellant material positioned substantially between a rearwardmost one of the projectile segments and a casing primer of the projectile casing, such that the propellant material and the casing neck of the projectile casing cooperate to assist with maintaining the temporary engagement between the projectile nose and the projectile segments;

whereby, upon the projectile assembly being fired from the firearm via the projectile casing, the projectile nose and projectile segments separate from one another upon subsequently exiting a barrel of the firearm, thereby causing the projectile nose and projectile segments to radially separate from one another in flight toward an intended target.

2. The segmented projectile apparatus of claim 1, wherein:

the nose engagement cavity of the projectile nose is coaxial with a longitudinal axis of the projectile nose;

the segment engagement cavity of each of the projectile segments is coaxial with a longitudinal axis of said projectile segment; and the engagement protrusion of each of the projectile segments is coaxial with the longitudinal axis of said projectile segment.

3. The segmented projectile apparatus of claim 1, wherein the engagement protrusion of each of the projectile segments further provides a tapered protrusion shoulder positioned and configured for creating a transition surface between the protrusion base and a segment trailing sidewall of the segment trailing end of said projectile segment.

4. The segmented projectile apparatus of claim 3, wherein a circumferential edge of the nose engagement cavity of the projectile nose provides a circumferential cavity chamfer configured for preventing the projectile nose and the forwardmost one of the projectile segments from fusing together upon the projectile assembly being fired from the firearm.

5. The segmented projectile apparatus of claim 4, wherein the cavity chamfer of the nose engagement cavity is configured for closely approximating the size, shape and dimensions of the protrusion shoulder of the forwardmost one of the projectile segments.

6. The segmented projectile apparatus of claim 5, wherein:

the cavity chamfer of the projectile nose has a chamfer diameter that is relatively smaller than a nose trailing diameter of the projectile nose, such that the nose trailing end provides a nose trailing perimeter face between the cavity chamfer and a nose trailing sidewall of the nose trailing end;

the nose trailing perimeter face is oriented substantially normal to the nose trailing sidewall; and the chamfer diameter of the cavity chamfer of the projectile nose is also relatively smaller than a shoulder diameter of the protrusion shoulder of the forwardmost one of the projectile segments, thereby creating a circumferential engagement gap between the nose trailing perimeter face and the protrusion shoulder of forwardmost one of the projectile segments.

7. The segmented projectile apparatus of claim 3, wherein a circumferential edge of the segment engagement cavity of each of the at least one trailing one of the projectile segments provides a circumferential cavity chamfer configured for preventing said at least one trailing one of the projectile segments and an immediately succeeding trailing one of the projectile segments from fusing together upon the projectile assembly being fired from the firearm.

8. The segmented projectile apparatus of claim 7, wherein the cavity chamfer of the segment engagement cavity of the at least one trailing one of the projectile segments is configured for closely approximating the size, shape and dimensions of the protrusion shoulder of the immediately succeeding trailing one of the projectile segments.

9. The segmented projectile apparatus of claim 8, wherein:

the cavity chamfer of the segment engagement cavity of the at least one trailing one of the projectile segments has a chamfer diameter that is relatively smaller than a segment trailing diameter of said projectile segment, such that the segment trailing end provides a segment trailing perimeter face between the cavity chamfer and a segment trailing sidewall of the segment trailing end;

the segment trailing perimeter face is oriented substantially normal to the segment trailing sidewall; and the chamfer diameter of said projectile segment is also relatively smaller than a shoulder diameter of the protrusion shoulder of an immediately succeeding trailing one of the projectile segments, thereby creating a circumferential engagement gap between said projectile segments.

10. The segmented projectile apparatus of claim 1, wherein:

the nose engagement cavity has a cavity diameter that is approximately 0.002 inches larger than a base diameter of the protrusion base of the forwardmost one of the projectile segments; and the segment engagement cavity of each of the projectile segments has a cavity diameter that is approximately 0.002 inches larger than a base diameter of the engagement protrusion of the corresponding at least one trailing one of the projectile segments.

11. The segmented projectile apparatus of claim 1, wherein the projectile assembly further comprises:

a temporary adhesive material positioned between the segment leading end of the forwardmost one of the projectile segments and the nose trailing end of the projectile nose; and the temporary adhesive material further positioned between the segment leading end of each of the at least one trailing one of the projectile segments and the segment trailing end of the immediately preceding one of the projectile segments;

wherein, the temporary adhesive material is configured for breaking down or otherwise breaking apart from a percussive force of the projectile assembly being fired from the firearm.

12. The segmented projectile apparatus of claim 1, wherein the projectile assembly further comprises:

a projectile sabot sized and configured for tightly conforming to and temporarily encompassing the projectile nose and projectile segments, so as to temporarily retain the projectile nose and projectile segments in substantially axially aligned abutting contact;

wherein, the temporary projectile sabot is configured for breaking down or otherwise breaking apart from a percussive force of the projectile assembly being fired from the firearm.

13. The segmented projectile apparatus of claim 1, wherein the projectile assembly further comprises:

an at least one elongate connector shaft extending through a corresponding connector passage of each of the projectile nose and projectile segments, the at least one connector shaft having a shaft diameter that closely approximates an inner diameter of each of the nose engagement cavity of the nose trailing end of the projectile nose and the connector passage of each of the projectile segments, so as to create a frictional engagement therebetween;

wherein, the at least one connector shaft is configured for breaking down or otherwise breaking apart from a percussive force of the projectile assembly being fired from the firearm.

14. The segmented projectile apparatus of claim 13, wherein the at least one connector shaft extends coaxially through each of the projectile nose and projectile segments.

15. The segmented projectile apparatus of claim 1, wherein:

the projectile nose and projectile segments are of unitary construction, with the projectile nose and projectile segments being longitudinally spaced apart from, and interconnected with, one another by an at least one connector portion extending therebetween;

wherein, the at least one connector portion is configured for breaking down or otherwise breaking apart from a percussive force of the projectile assembly being fired from the firearm.

16. The segmented projectile apparatus of claim 15, wherein the at least one connector portion is coaxially aligned with each of the projectile nose and projectile segments.

17. A segmented projectile apparatus for a firearm, the apparatus comprising:

a projectile casing; and a projectile assembly frictionally positioned within the projectile casing, the projectile assembly comprising:

a plurality of projectile segments temporarily engageable with one another in axially aligned series, each projectile segment having a segment leading end and an opposing segment trailing end;

the segment leading end of each of the segment projectiles providing an engagement protrusion which provides a protrusion base on which is positioned a protrusion tip; and the engagement protrusion of each of an at least one trailing one of the projectile segments configured for being removably engaged with a corresponding rearwardly opening segment engagement cavity provided by the segment trailing end of an immediately preceding one of the projectile segments, so as to create a temporary frictional, press-fit engagement therebetween;

whereby, upon the projectile assembly being fired from the firearm via the projectile casing, the projectile segments separate from one another upon subsequently exiting a barrel of the firearm, thereby causing the projectile segments to radially separate from one another in flight toward an intended target.

18. A segmented projectile apparatus for a firearm, the apparatus comprising:

a projectile casing;

a projectile assembly frictionally positioned within the projectile casing, the projectile assembly comprising:

a projectile nose and a plurality of projectile segments temporarily engageable with one another in axially aligned series;

the projectile nose frictionally positioned within a casing neck of the projectile casing and having a substantially ogive-shaped nose leading end and an opposing nose trailing end;

each of the projectile segments having a segment leading end and an opposing segment trailing end;

the segment leading end of each of the segment projectiles providing an engagement protrusion substantially coaxially aligned with a longitudinal axis of said projectile segment, the engagement protrusion providing a protrusion base on which is positioned a protrusion tip;

the engagement protrusion of a forwardmost one of the projectile segments configured for being removably engaged with a corresponding rearwardly opening nose engagement cavity provided by the nose trailing end of the projectile nose, so as to create a temporary frictional, press-fit engagement therebetween, the nose engagement cavity substantially coaxially aligned with a longitudinal axis of the projectile nose;

a circumferential edge of the nose engagement cavity providing a circumferential cavity chamfer configured for preventing the projectile nose and the forwardmost one of the projectile segments from fusing together upon the projectile assembly being fired from the firearm;

the engagement protrusion of each of an at least one trailing one of the projectile segments configured for being removably engaged with a corresponding rearwardly opening segment engagement cavity provided by the segment trailing end of an immediately preceding one of the projectile segments, so as to create a temporary frictional, press-fit engagement therebetween, each segment engagement cavity substantially coaxially aligned with the longitudinal axis of the corresponding projectile segment; and a circumferential edge of the segment engagement cavity of each of the at least one trailing one of the projectile segments providing a circumferential cavity chamfer configured for preventing said at least one trailing one of the projectile segments and an immediately succeeding trailing one of the projectile segments from fusing together upon the projectile assembly being fired from the firearm; and a volume of compressed propellant material positioned substantially between a rearwardmost one of the projectile segments and a casing primer of the projectile casing, such that the propellant material and the casing neck of the projectile casing cooperate to assist with maintaining the temporary engagement between the projectile nose and the projectile segments;

whereby, upon the projectile assembly being fired from the firearm via the projectile casing, the projectile nose and projectile segments separate from one another upon subsequently exiting a barrel of the firearm, thereby causing the projectile nose and projectile segments to radially separate from one another in flight toward an intended target.

* * * * *